US007858280B2

(12) United States Patent
Sugimoto et al.

(10) Patent No.: US 7,858,280 B2
(45) Date of Patent: Dec. 28, 2010

(54) TONER AND IMAGE FORMING METHOD USING THE SAME

(75) Inventors: Tsuyoshi Sugimoto, Numazu (JP); Hiroshi Yamashita, Numazu (JP); Hiroto Higuchi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 512 days.

(21) Appl. No.: 11/339,731

(22) Filed: Jan. 26, 2006

(65) Prior Publication Data

US 2006/0177756 A1 Aug. 10, 2006

(30) Foreign Application Priority Data

Jan. 26, 2005 (JP) ..... 2005-018870
May 26, 2005 (JP) ..... 2005-154364

(51) Int. Cl.
*G03G 9/087* (2006.01)

(52) U.S. Cl. ..... 430/108.1; 430/108.8; 430/109.1

(58) Field of Classification Search ..... 430/108.1, 430/108.8, 109.1
See application file for complete search history.

(56) References Cited

U.S. PATENT DOCUMENTS

| | | | | |
|---|---|---|---|---|
| 3,880,656 | A * | 4/1975 | Nagashima et al. | 430/120.4 |
| 3,980,575 | A * | 9/1976 | De Roo et al. | 430/108.4 |
| 4,407,922 | A * | 10/1983 | Grushkin et al. | 430/123.5 |
| 4,762,763 | A * | 8/1988 | Nomura et al. | 430/108.3 |
| 4,888,263 | A * | 12/1989 | Tomita et al. | 430/108.3 |
| 5,240,814 | A | 8/1993 | Held | |
| 5,275,903 | A | 1/1994 | Sundarajan et al. | |
| 5,370,959 | A * | 12/1994 | Hagiwara et al. | 430/123.51 |
| 6,562,538 | B2 * | 5/2003 | Miyamoto | 430/108.6 |
| 7,247,416 | B2 * | 7/2007 | Hsieh et al. | 430/137.19 |
| 2002/0031657 | A1 * | 3/2002 | Kimura et al. | 428/306.6 |
| 2004/0038143 | A1 * | 2/2004 | Riley et al. | 430/108.11 |
| 2004/0166429 | A1 * | 8/2004 | Higuchi et al. | 430/111.4 |
| 2004/0265721 | A1 * | 12/2004 | Matsuoka et al. | 430/109.4 |
| 2005/0003288 | A1 * | 1/2005 | Sugiyama et al. | 430/108.1 |
| 2005/0008961 | A1 * | 1/2005 | Takada et al. | 430/108.6 |
| 2005/0282077 | A1 * | 12/2005 | Riley et al. | 430/108.2 |
| 2006/0078814 | A1 * | 4/2006 | Hsieh et al. | 430/108.7 |
| 2006/0093934 | A1 * | 5/2006 | Roberts et al. | 430/108.1 |
| 2006/0093945 | A1 * | 5/2006 | Dalzell et al. | 430/109.1 |

FOREIGN PATENT DOCUMENTS

| | | |
|---|---|---|
| JP | 05-107799 | 4/1993 |
| JP | 06-019182 | 1/1994 |
| JP | 06-258861 | 9/1994 |
| JP | 09-319137 | 12/1997 |
| JP | 2001-281909 | 10/2001 |
| JP | 2002-072557 | 3/2002 |
| JP | 2002-202627 | 7/2002 |
| JP | 2002-221825 | 8/2002 |
| JP | 2004-053705 | 2/2004 |
| JP | 2005-092095 | 4/2005 |

OTHER PUBLICATIONS

U.S. Appl. No. 11/669,817, filed Jan. 31, 2007, Suzuki, et al.
U.S. Appl. No. 12/049,686, filed Mar. 17, 2008, Kotsugai, et al.
U.S. Appl. No. 11/854,842, filed Sep. 13, 2007, Sugimoto, et al.
U.S. Appl. No. 11/857,999, filed Sep. 19, 2007, Yamashita, et al.
U.S. Appl. No. 12/209,583, filed Sep. 12, 2008, Seshita, et al.
U.S. Appl. No. 12/248,313, filed Oct. 9, 2008, Sugimoto, et al.

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A toner formed of a toner composition containing a resin and a plasticizer, wherein the following relationships (1) and (2) are satisfied:

$$Tg2r > Tg2t \quad (1),$$

and $$Tg1t - Tg2t > Tg1r - Tg2r \quad (2),$$

wherein Tg1r represents the peak of the resin for the first temperature rise and Tg2r represents the peak of the resin for the second temperature rise when a differential scanning calorimeter (DSC) measurement is performed for the resin, Tg1t represents the peak of the toner comprising the resin for the first temperature rise and Tg2t represents the peak of the toner comprising the resin for the second temperature rise when a differential scanning calorimeter (DSC) measurement is performed for the toner.

32 Claims, 5 Drawing Sheets

TONER AND IMAGE FORMING METHOD USING THE SAME

BACKGROUND OF THE INVENTION

1. Field of the Invention

The present invention relates to a toner for use in electrophotography, and an image forming method using the toner.

2. Discussion of the Background

Electrophotographic image formation is typically performed by the following series of processes as described in U.S. Pat. No. 2,297,691:

(1) Forming a latent electrostatic image on a photoreceptor, i.e., a latent electrostatic image bearing member;

(2) Visualizing the latent electrostatic image with developer to form a visualized image (toner image); and (3) Transferring the visualized image on a recording medium such as paper; and (4) Fixing the transferred image to obtain a fixed image.

Conventional developers include single component developers using a magnetic toner or a non-magnetic toner, and double-component developers containing toner and carrier.

As for the fixing method mentioned above, a heat roller system is widely used in which a heat roller is directly contact-pressed to a toner image on a recording medium in terms of energy efficiency. However, when such a heat roller system is used, there is a drawback in that a large amount of electric power is required for the fixing. Therefore, in attempts to save energy, reducing the consumption of power by the heat roller has been variously studied. For example, there is a widely used system in which the power of a heat roller is reduced when no image is output and is increased when images are output. However, such a system requires several tens of seconds waiting time from a sleeping time before the temperature of the heat roller is raised enough for fixing. This waiting time is a stressful time for a user. In addition, when images are not output, it is demanded that the heater for a heat roller should be completely off for further restraint on power consumption. To satisfy these demands, it is preferred to obtain a toner having a low fixing temperature.

To obtain such toner having a low fixing temperature, it is desired to control the thermal characteristics of a resin in the toner. For example, a method has been proposed in which the glass transition temperature (Tg) of a resin is lowered by adding a melting-mixable material (hereinafter referred to as plasticizer) having a plasticizing effect. However, when Tg is excessively lowered, thermal preservability deteriorates. When the 1/2 temperature ($F_{1/2}$) in the flow tester method is excessively lowered, a drawback arises such that the hot offset occurrence temperature is lowered. Therefore, it has been a long-standing challenge to develop a toner having a good combination of low temperature fixability and heat resistant property, which have a trade-off relationship.

To achieve such a good combination of low temperature fixability and heat-resistant preservability, for example, published unexamined Japanese patent application No. (hereinafter referred to as JOP) H06-258861 describes a toner in which a resin without containing a plasticizer protrudes from the surface of the toner particle. The inside of the toner particle having such resin protruding therefrom is mainly formed of a resin having a low Tg. Therefore, it is difficult to provide such a toner with a good combination of low temperature fixability and heat resistance property.

For example, JOP 2002-221825 describes toner containing a binder resin and a wax having a melting point of 20 to 150°

C. When the binder resin is thermally dissolved in the wax functioning as a solvent followed by rapid cooling down, the binder resin is not separated and precipitated in the wax. In the toner, the wax has a plasticizing effect for a resin having a melting point higher than the fixing temperature. Therefore, the toner has a good low temperature property. However, the toner is manufactured by a pulverization method including a melting and kneading process. Thereby, the toner already has a plasticizing effect when manufactured, resulting in insufficiency of heat-resistant property.

JOP 2002-202627 describes toner containing a resin and two kinds of waxes. One is compatible with the resin monomer and the other is not compatible therewith. However, the toner described in JOP 2002-202627 is mainly for a single-component developer and its object is to uniformly disperse a magnetic substance in the toner. The plasticizing effect of the wax compatible with the toner is a supplemental effect in comparison to the dispersion of the magnetic substance. In addition, in the process of manufacturing the toner, there is a heating process in which the temperature is higher than the melting point of the compatible wax. Therefore, as in the toner described in JOP 2002-221825, the toner already shows a plasticizing effect when manufactured, which leads to a problem that the heat-resistant property deteriorates.

JOP 2001-281909 describes toner containing a multi-functional ester compound compatible with the resin monomer. However, it is just that the resin monomer used in the toner has a melting point close to the melting point of the multi-functional ester compound. The glass transition temperature (Tg) of the toner means that the toner is in the state in which the plasticizing effect of the multi-functional ester compound is already shown. Therefore, it is also impossible for the toner to sufficiently obtain a good combination of the low temperature fixability and the heat-resistant property.

To obtain a good combination of the low temperature fixability and the heat-resistant property, for example, microcapsule toner has been proposed which has a shell portion formed of a compound having a high melting point and a core portion formed of a coloring phase which is liquid at room temperature. As an example of such toner, JOP H06-19182 describes a microcapsule toner having a micro phase separation structure formed of a dispersion phase and a continuous phase and having a copolymer compatible with both phases as a core portion to improve stability of the image after fixing. However, in the toner having such a structure, it is still necessary to apply pressure on fixing. In addition, such toner still has such problems as stability of the toner, disturbance of the image, and deterioration of gloss. Therefore, it is still impossible to obtain characteristics desirable as toner.

SUMMARY OF THE INVENTION

Because of these reasons, the present inventors recognize that a need exists for toner having an excellent combination of low temperature fixability and heat-resistant property to obtain good characteristics such as fluidity and fixability of toner. Further, by the toner, quality images can be obtained and saving energy and shortening of waiting time can be realized.

Accordingly, an object of the present invention is to provide toner having good characteristics of fluidity, fixability, etc., and having an excellent combination of low temperature fixability and heat-resistant property to obtain quality images. Other objects of the present invention are to provide an image forming apparatus and an image forming method using the toner.

Briefly these objects and other objects of the present invention as hereinafter described will become more readily apparent and can be attained, either individually or in combination thereof, by a toner including a toner composition containing a resin, and a plasticizer. In the toner, the following relationships (1) and (2) are satisfied:

$$Tg2r>Tg2t \quad (1)$$

$$Tg1t-Tg2t>Tg1r-Tg2r \quad (2).$$

In the relationships, Tg1r represents the peak of the resin for a first temperature rise and Tg2r represents the peak of the resin for a second temperature rise when a differential scanning calorimeter (DSC) measurement is performed for the resin, Tg1t represents the peak of the toner formed using the resin for the first temperature rise and Tg2t represents the peak of the toner formed using the resin for the second temperature rise when a differential scanning calorimeter (DSC) measurement is performed for the toner.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
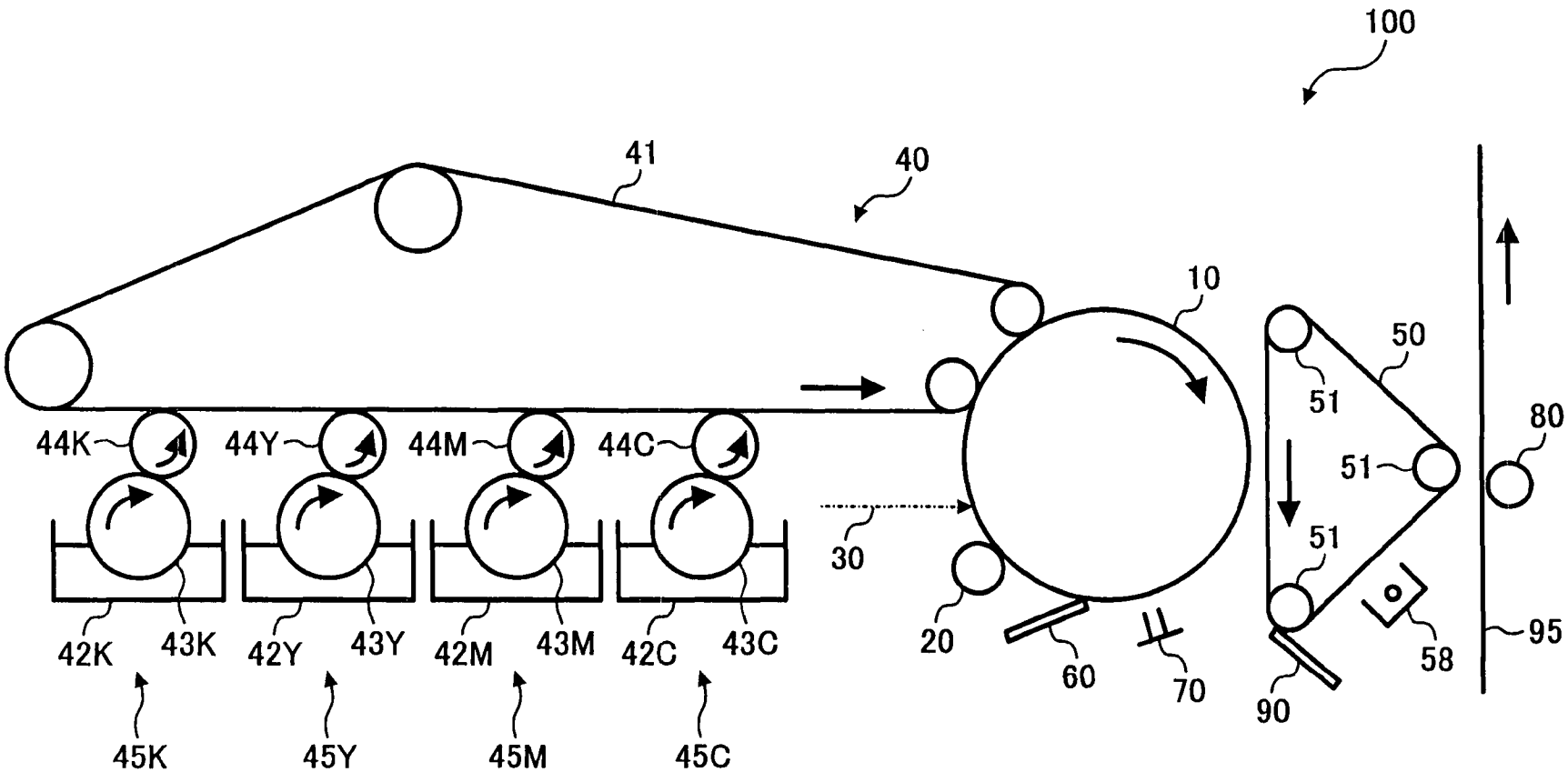
FIG. 1 is a schematic diagram illustrating an example of performing image formation by the image forming method of the present invention with an image forming apparatus.

The present invention will be described below in detail with reference to several embodiments and accompanying drawings.

The toner of the present invention contains a resin. When DSC measurement is performed for the resin and the toner containing the resin, the following relationships (1) and (2) are satisfied:

$$Tg2r>Tg2t \quad (1)$$

$$Tg1t-Tg2t>Tg1r-Tg2r \quad (2)$$

In the relationships, Tg1r represents the peak of the resin for the first temperature rise, and Tg2r represents the peak of the resin for the second temperature rise. Tg1t represents the peak based on the resin contained in the toner by DSC measurement of the toner for the first temperature rise and Tg2t represents the peak based on the resin contained in the toner by DSC measurement of the toner for the second temperature rise.

As another aspect of the present invention, a method of manufacturing toner is provided which includes preparing an emulsification or dispersion liquid by emulsifying or dispersing a solution or dispersion liquid of a toner component in an aqueous medium, and granulating the toner mentioned above.

It is still further preferred that the granulating further includes reacting a compound having an active hydrogen group and a polymer reactive therewith to form an adhesive base material and to obtain particles comprising an adhesive base material.

It is still further preferred that the method of manufacturing toner further includes dissolving or dispersing the toner composition in an organic solvent to prepare the emulsification or dispersion liquid of the toner composition.

It is still further preferred that the toner is manufactured in a temperature range of from 10 to 100° C.

It is still further preferred that the toner is manufactured in a temperature range of from 20 to 60° C.

As another aspect of the present invention, an image forming method is provided which includes forming a latent electrostatic image on a latent electrostatic image bearing member, developing the latent electrostatic image with the toner mentioned above, transferring the visualized image to a recording medium, and fixing the transferred image to the recording medium.

As another aspect of the present invention, an image forming method is provided which includes supplying an image bearing member with the toner mentioned above, temporarily fixing a visualized image on the image bearing member by forming the visualized image with a portion of the toner contacting the image bearing member where heat is applied according to image signals, and transferring the temporarily fixed visualized image to a recording medium and thermally fusing and fixing the transferred image.

Since the toner satisfies the relationship (1), the toner can have a low glass transition temperature. Since the toner satisfies the relationship (2), the low glass transition temperature is expressed during heating. That is, when the toner is preserved, the toner has a high glass transition temperature, and when the toner is heated, its glass transition temperature is lowered. Therefore, the toner has an excellent combination of low temperature fixability and heat-resistant property. When image formation is performed using the toner, quality images can be obtained under the conditions of low temperature fixing.

In addition, for example, the following forms of the toner are preferred: (1) a form of the toner in which the resin and a plasticizer are compatible when heated and the plasticizer has a melting point of not less than 30° C.; (2) a form of the toner containing the resin containing an acid group and at least one of a metal salt and a metal complex performing a cross-linkage reaction with the acid group; (3) a form of the toner containing a trivalent or higher cross-linking agent; and (4) a form of the toner which is granulated after preparing an emulsion or a dispersion liquid in which a solution or dispersion liquid of a toner composition is emulsified or dispersed in an aqueous medium, the toner composition contains a compound having an active hydrogen group and a polymer reactive with the compound having an active hydrogen group, and the granulation is performed by obtaining particles containing an adhesive base material which is produced by reacting the compound having an active hydrogen group and the polymer reactive with the compound having an active hydrogen group.

The toner of the present invention preferably contains a wax which is present in a non-compatible state with the resin and the plasticizer. As a result, after the wax and the plasticizer are melted, since the wax and the plasticizer are non-compatible with each other, decrease of the releasability of the wax can be prevented. Further, since the plasticizer and the resin are compatible with each other when heated, the low temperature fixing property can be improved. Therefore, a toner having a good combination of low temperature fixing property, preservability and releasability can be provided.

Therefore, when electrophotographic image formation is performed with a developer containing the toner of the present invention, clear and quality images having high image definition can be obtained even under the conditions of low temperature fixing.

When electrophotographic image formation is performed using a container accommodating the toner of the present invention, clear and quality images having high image definition can be obtained even under the conditions of low temperature fixing.

When electrophotographic image formation is performed using a process cartridge having a latent electrostatic image bearing member and a developing device to form a visualized image by developing the latent electrostatic image formed on the latent electrostatic image bearing member with the toner of the present invention, clear and quality images having high image definition can be obtained under the conditions of low temperature fixing. In addition, the process cartridge can be detachably attached to an image forming apparatus and thereby can improve convenience of a user.

In a form of the image forming apparatus of the present invention, there are provided a latent electrostatic image bearing member, a latent electrostatic image forming device to form a latent electrostatic image on the latent electrostatic image bearing member, a developing device to form a visualized image by developing the latent electrostatic image with the toner of the present invention, a transfer device to transfer the visualized image to a recording medium, and a fixing device to fix the transferred image on the recording medium. In the image forming apparatus, the latent electrostatic image forming device forms a latent electrostatic image on the latent electrostatic image bearing member. The developing device forms a visualized image by developing the latent electrostatic image with the toner of the present invention. The transfer device transfers the visualized image to a recording medium. The fixing device fixes the transferred image on the recording medium. Consequently, clear and quality images having high image definition can be obtained even under the conditions of low-temperature fixing.

In another form of the image forming apparatus of the present invention, the image forming apparatus includes an image bearing member, a toner supplying device, a visualized image temporary fixing device, and a heat fusion fixing device. The toner supplying device supplies the toner of the present invention to the surface of the image bearing member. The visualized image temporary fixing device applies heat to the toner contacting the image bearing member according to imagewise signal to temporarily fix the toner on the image bearing member. Thereby, a visualized image is formed with the toner on the portion where the heat is applied. The heat fusion fixing device transfers the temporarily fixed and visualized image to a recording medium. In the image forming apparatus, the toner supplying device supplies toner of the present invention to the image bearing member. The visualized image temporary fixing device applies heat to the toner contacting the image bearing member according to imagewise signal to form a visualized image with toner on the portion where the heat is applied. Thereby, the visualized image is temporarily fixed. The heat fusion fixing device transfers the temporarily fixed visualized image to a recording medium and fuses and fixes the image upon application of heat. Consequently, this form makes forming a latent electrostatic image on an image bearing member unnecessary. Therefore, clear and quality images having high image definition can be formed at a high speed.

In a form of the image forming method of the present invention, there are provided a latent electrostatic image forming process in which latent electrostatic images are formed on a latent electrostatic image bearing member, a developing process in which a visualized image is formed by developing the latent electrostatic image with the toner of the present invention, a transfer process in which the visualized image is transferred to a recording medium, and a fixing process in which the transferred image on the recording medium is fixed. In the image forming method, a latent electrostatic image is formed on the latent electrostatic image bearing member. In the developing process, the latent electrostatic image is developed with the toner of the present invention to form a visualized image. In the transfer process, the visualized image is transferred to a recording medium. In the fixing process, the transferred image transferred to the recording medium is fixed. Consequently, clear and quality images having high image definition can be obtained under the conditions of low fixing temperature.

In another form of the image forming method of the present invention, the image forming method includes a toner supplying process to supply the toner of the present invention to an image bearing member, a visualized image temporary fixing process, and a heat fusion fixing process. In the visualized image temporary fixing process, heat is applied to the toner contacting the image bearing member according to an imagewise signal to temporarily fix the toner on the image bearing member. Thereby, a visualized image is formed with the toner on the portion where the heat is applied. In the heat fusion fixing process, the temporarily fixed and visualized image is transferred to a recording medium. In the image forming method, in the toner supplying process, toner of the present invention is supplied to the image bearing member. In the visualized image temporary fixing process, heat is applied to the toner contacting the image bearing member according to imagewise signal to form a visualized image with toner on the portion where the heat is applied. Thereby, the visualized image is temporarily fixed. In the heat fusion fixing process, the temporarily fixed visualized image is transferred to a recording medium and fused and fixed upon application of heat. Consequently, this form makes forming a latent electrostatic image on an image bearing member unnecessary. Therefore, clear and quality images having high image definition can be formed at a high speed.

Toner

The toner of the present invention contains a resin and a plasticizer. When DSC measurement is performed for the resin and the toner containing the resin, the following relationships (1) and (2) are satisfied:

$$Tg2r > Tg2t \quad (1)$$

$$Tg1t - Tg2t > Tg1r - Tg2r \quad (2)$$

In the relationships, Tg1r represents the peak of the resin for the first temperature rise, and Tg2r represents the peak of the resin for the second temperature rise. Tg1t represents the peak based on the resin contained in the toner by DSC measurement of the toner for the first temperature rise and Tg2t represents the peak based on the resin contained in the toner by DSC measurement of the toner for the second temperature rise.

It is preferred that the toner of the present invention contains a trivalent or higher cross-linkage agent, a plasticizer. Further, the toner of the present invention can contain other components such as a colorant, a release agent such as a wax and a charge control agent, if desired. It is further preferred that, the toner preferably contains a wax functioning as a release agent which is non-compatible with the resin and the plasticizer.

Resin

There is no specific limit to the resin as long as the relationships (1) and (2) mentioned above are satisfied. For example, known resins can be mentioned based on the desired purpose.

The relationship (1) represents that the glass transition temperature of the toner is lower than that of the resin. The relationship (2) represents that the glass transition temperature declines when the toner is heated.

Tg2r is larger than Tg2t and the difference of the two (Tg2r−Tg2t) preferably satisfies the following relationship: Tg2r−Tg2t>10° C. As the difference (Tg2r−Tg2t) increases, the values of the thermal characteristics of the resin significantly decrease upon application of heat at fixing. Thereby, the lower limit of the fixing temperature of the toner can be lowered. When the difference mentioned above is too small, the low temperature fixability tends to be insufficient.

In addition, it is preferred that the difference (Tg1r−Tg1t) satisfies the following relationship: Tg1r−Tg1t<5° C. When this difference is less than 5° C., the glass transition temperatures of the simple resin and the toner are close while in preservation so that the heat-resistant preservability is maintained at a high level.

When the toner of the present invention contains plasticizer, the peak Tg1r of the resin for the first temperature rise in the DSC measurement is higher than the melting point Tm of the plasticizer, that is, Tg1r>Tm, and Tg1r preferably satisfies the following relationship: 100° C.>Tg1r>60° C. Namely, the peak Tg1r of the resin for the first temperature rise is preferably low in terms of low temperature fixability, but when the peak Tg1r is lower than the melting point of the plasticizer, the peak Tg1r can be as high as the following range: 100° C.>Tg1r≧60° C.

The toner preferably contains a wax in a condition in which the wax and the resin are existent in a non-compatible state. When the wax contained in the toner is existent in a non-compatible state with the plasticizer, it is preferred to satisfy the following relationships (3) and (4).

$$|Tp-Tp'|<1(^\circ\text{ C.}) \quad (3)$$

$$|Tw-Tw'|<1(^\circ\text{ C.}) \quad (4).$$

In the relationships (3) and (4), Tp represents the melting peak of the plasticizer and Tw represents the melting peak of the resin when DSC measurement is performed for the plasticizer and the wax, and Tp' represents the melting peak deriving from the plasticizer of a mixture of the plasticizer and the wax in a mixed ratio of 1 to 1 for the second temperature rise when DSC measurement is performed for the mixture. In addition, Tw' represents the melting peak deriving from the wax of the mixture for the second temperature rise when DSC measurement is performed for the mixture.

When the wax and the plasticizer are independently existent, the respective melting peaks are the same without shifting before and after heating. Therefore, it is possible to confirm that the wax and the plasticizer are in a non-compatible state as long as the wax and the plasticizer satisfy the relationships (3) and (4). It is further preferred that the following relationship (5) is satisfied: |Tp−Tw|>10(° C.) (5). When |Tp−Tw| is too small, the plasticizer and the wax are easily compatible with each other when heated, which leads to deterioration of cold offset property.

The melting point (Tp) of the plasticizer is preferably from higher than 50° C. to lower than 120° C. and more preferably from 50° C. to lower than 80° C. When the melting point (Tp) is too low, heat-resistant property of the toner may deteriorate. When the melting point (Tp) is too high, the compatibility upon application of heat tends to be insufficient, which may lead to deterioration of low temperature fixability.

The melting point (Tw) of the wax is preferably from higher than 50° C. to lower than 120° C. and more preferably from 60° C. to lower than 90° C.

When the melting point (Tw) is too low, the wax may have an adverse impact on heat-resistant property of the toner. When the melting point (Tw) is too high, cold offset tends to occur at fixing at a low temperature.

It is preferred in the toner of the present invention that the resin has an acid group and a cross-linkage agent such as metal salt and metal complex is used for a cross-linkage reaction with the acid group. By containing such a metal salt or a metal complex, the cross linkage reaction proceeds when heated, which leads to prevention of occurrence of copy blocking.

Specific examples of the resins having an acid group include resins having an acid group such as a carboxyl group and a sulfonate group, and resins in which the acid component of a polymer such as acrylic acid and methacrylic acid or a polyester resin is excessively composed and synthesized. Among them, resins containing a carboxyl group, a sulfonate group, etc., are preferred. In addition, it is possible to introduce a single functional monomer to a polyester by endcapping the polar radical at the end of the polyester to improve the environmental stability of the toner charging characteristics. Specific examples of the single functional monomer include monocarboxylic acids such as benzoic acid, chlorobenzoic acid, bromobenzoic acid, parahydroxybenzoic acid, monoammonium salt of sulfo benzoic acid, monosodium salt of sulfobenzoic acid, cyclohexyl amino carbonyl benzoic acid, n-dodecyl amino carbonyl benzoic acid, tertial butylbenzoic acid, naphthalene carboxylic acid, 4-methyl benzoic acid, 3-methyl benzoic acid, salicylic acid, thiosalicylic acid, phenyl acetic acid, acetic acid, propionic acid, butylic acid, isobutylic acid, octane carboxylic acid, lauric acid, and stearylic acid, lower alkyl esters thereof, and mono-alcohols such as fatty acid alcohols, aromatic alcohols and alicyclic alcohols.

The resin preferably has a hydroxyl value of not less than 20 mg[KOH]/g. A toner containing the resin having a hydroxyl value of not less than 20 mg[KOH]/g, the toner has a good hot offset property. This is thought to be because the hydroxyl group forms a weak three-dimensional structure with a functional group in a cross linkage agent easily forming a cross linkage.

Cross-Linkage Agent

The cross-linkage agent is preferably either of a metal salt or a metal complex.

Specific examples of the metal salts and the metal complexes include a metal salt or complex of the derivatives of salicylic acid, and a metal salt or complex of acetyl acetate.

There is no specific limit to the metal as long as the metal is a polyvalent ion metal. Specific examples of the metals include zinc, iron, zirconium, chromium, etc.

The cross-linkage agent is preferably tri- or higher valent. When a tri- or higher valent cross-linkage agent is contained, the anti-hot offset property of the toner is improved. This is thought to be because a metal complex reacts with highly-reactive portions of the resin and the wax described later and a slightly cross-linked structure is formed, which leads to improvement of anti-hot offset property.

Tri- or higher valent metal compounds of salicylic acid can be suitably used as the tri- or higher valent cross-linkage agent. One of the specific examples thereof is a metal compound of salicylic acid represented by the following chemical formula (1):

[Chemical Formula 1]

(1)

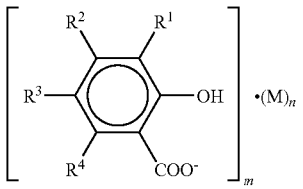

In the formula (1), $R^1$, $R^2$, $R^3$ and $R^4$ are each, independently, one of a hydrogen atom, an alkyl group having 1 to 18 carbon atoms, and an allyl group. Either group of $R^1$ and $R^2$, $R^2$ and $R^3$, and $R^3$ and $R^4$ can form an aromatic ring or alicyclic ring which can have a substituent group by linkage. M represents a metal, m represents an integer of 3 or higher, and n represents an integer of 2 or higher.

There is no specific limit to M, which is a central metal, as long as M is a tri- or higher valent metal. Therefore, M can be suitably selected according to the purpose. Fe, Ni, Al, Ti and Zr are preferred. Among them, Fe is particularly preferred in terms of the safety to human body.

The content of the cross-linkage agent is preferably from 0.05 to 10 parts by weight based on 100 parts by weight of toner, and more preferably from 0.5 to 5 parts by weight. When the content is too small, the anti-hot offset property of the toner may be insufficient. When the content is too large, the toner has a good anti-hot offset property but the low temperature fixability thereof may be insufficient.

Plasticizer

The plasticizer is compatible with the resin when heated. The variation of the glass transition temperature of the plasticizer is preferably large when compatible with the resin because, as the variation increases, the low temperature fixability is improved. When 5 parts by weight of a plasticizer is compatible with 100 parts by weight of a resin, it is preferred that the plasticizer can decrease the glass transition temperature at least 5° C. lower than the glass transition temperature of the simple resin, i.e., Tg2r.

When a plasticizer is crystal, the state (compatible or non-compatible) of maintaining the crystability can be measured by peak area obtained by X-ray diffraction chart.

Specifically, when a plasticizer is crystal, whether or not the plasticizer is dissolved in a resin before and after heating can be confirmed as follows by crystal analysys X ray diffraction device (X'Pert MRDX'Pert MRD, manufactured by Royal Philips Electronics): grind a plasticizer in a mortar to obtain a sample powder; uniformly apply the obtained sample powder to the sample holder; thereafter, set the sample holder in the diffraction device; measure the diffraction spectrum of the plasticizer; apply toner powder to the holder; and perform measurement. It is possible to determine the plasticizer contained in the toner based on the diffraction spectrum of the plasticizer beforehand. In addition, it is also possible to measure changes of the diffraction spectrum when the temperature is changed by an accessory heating unit. The ratio of the dissolved and non-dissolved portions of the plasticizer in a resin before and after heating can be obtained based on the changes in the peak area of the X ray diffraction spectrum deriving from the plasticizer at room temperature and 150° C. using the heating unit.

When the resin and the plasticizer are independently existent, meaning that both are not in a compatible state, good heat-resistant preservability thereof is desired. When the resin and the plasticizer are heated during fixing, the resin and the plasticizer are desired to be rapidly dissolved to each other to obtain a high level low temperature fixability. Therefore, the melting point (Tm) of the plasticizer is preferably from 30° C. to lower than 120° C. and more preferably from 50° to lower than 120° C. When the melting point Tm is too low, heat-resistant preservability thereof may be inferior. When the melting point Tm is too high, the compatibility between the resin and the plasticizer tends to be insufficient, which leads to inferiority of low temperature fixability.

There is no specific limit to the selection of the plasticizers. The plasticizers can be suitably selected to the purpose and specific examples thereof include esters of an aliphatic acid, esters of an aromatic acid such as phthalic acid, esters of phosphoric acid, esters of maleic acid, esters of fumaric acid, esters of itaconic acid, ketones such as benzoin compounds, and benzoil compounds, hindered phenol compounds, benzotriazol comopounds, aromatic sulfonamide compounds, aliphatic amide compounds, long-chain alcohols, long-chain di-alcohols, long-chain carboxylic acids, and long-chain di-carboxylic acids.

Specific examples thereof include dimethyl fumarate, monoethyl fumarate, monobuthyl fumarate, monomethyl itaconate, monobuthyl itaconate, diphenyl adipate, dibenzyl terephthalate, di-benzoil isophthalate, benzoin isopropyl ether, 4-benzoil biphenyl, 4-benzoil diphenyl ether, 2-benzoil naphthalene, dibenzoil methane, 4-biphenyl carboxylic acid, stearyl stearic acid amide, oleyl stearic acid amide, stearic oleic acid amide, octadecanol, n-octyl alcohol, tetracosanic acid, arachidic acid, stearic acid, lauric acid, nonadecanoic acid, palmitic acid hydroxy octanic acid, docosanic acid, and the compounds of chemical formulae (1) to (17) illustrated in JOP 2002-105414.

The weight average molecular weight (Mw) of the plasticizer is preferably not greater than 2,000 and more preferably not greater than 1,000. When the weight average molecular weight is too great, the plasticizer tends to lose sharp melting property. Therefore, a resin and the plasticizer may not be dissolved in each other so that the low temperature fixing property deteriorates.

The weight average molecular weight (Mw) of the plasticizer is preferably not greater than 2,000 and more preferably not greater than 1,000. When the weight average molecular weight is too great, the plasticizer tends to lose sharp melting property. Therefore, a resin and the plasticizer may not be dissolved in each other so that the low temperature fixing property deteriorates.

The plasticizer is preferably contained in the toner in a dispersion state. The dispersion particle diameter of the plasticizer is, for example, preferably from 10 nm to 3 μm and more preferably from 50 nm to 1 μm in the longitudinal direction.

When the dispersion particle diameter of the plasticizer is too small, its heat-resistant preservability tends to deteriorate due to the increase in the contact area between the plasticizer and the resin. When the dispersion particle diameter of the plasticizer is too large, its low temperature fixability may deteriorate since the plasticizer may not be sufficiently compatible with the resin when heated during fixing.

There is no specific limit to the measuring method to the dispersion particle diameter of the plasticizer. The measuring method can be selected to purposes. An example method is as follows: Embed toner in an epoxy resin and obtain an extremely thin piece having a thickness of about 100 nm; Dye the piece with ruthenium tetroxide; Observe the dyed piece with transmission electron microscope (TEM) with a magnifying power of 10,000; Take a photograph thereof; and observe the dispersion state of the plasticizer in the particle by evaluating the photograph for image to measure the dispersion diameter. When the dispersion body of the plasticizer is confirmed to be present in the particle, the state of the plasticizer is determined that the plasticizer is not contained in the toner in a manner in which the plasticizer and the resin are dissolved in each other and the plasticizer is dispersed at molecular level.

With regard to the solubility of the plasticizer it is preferred that the solubility is not greater than 1 weight % and more preferably not greater than 0.1 weight % in an organic solvent at a temperature not higher than 25° C. When the solubility is too large, the resin and the plasticizer may be dissolved in each other during toner manufacturing when the method of manufacturing toner, which is described later, is used.

In addition, it is preferred that the solubility is not less than 5 weight % and more preferably not less than 20 weight % in an organic solvent at a temperature not lower than 60° C. When the solubility is too small, the plasticizer may not be dissolved in the organic solvent mentioned above when heated, which leads to deterioration of the dispersion state of the plasticizer in the toner.

The solubility of the plasticizer in the organic solvent can be obtained by measuring the dissolved amount of the plasticizer based on 100 g of the organic solvent mentioned above at each measuring temperature.

The content of the plasticizer in the toner is preferably from 3 to 20 weight % and more preferably from 10 to 20 weight % in terms of a good combination of the low temperature fixability and heat-resistant preservability and maintaining high level toner characteristics such as chargeability and resolution. When the content is too small, the low temperature fixability easily deteriorates. When the content is too large, the area of the plasticizer on the surface of a toner particle tends to increase, resulting in deterioration of fluidity of the toner.

The glass transition temperature and the melting point of the resin, the toner and the plasticizer can be measured by, for example, a differential scanning calorimeter (DSC) system (DSC-60, manufactured by Shimadzu Corporation) as follows:

With regard to the glass transition temperature, i.e., Tg1r and Tg1t, of a resin and a toner for the first temperature rise, put about 5.0 mg of a sample resin or a sample toner in a sample material container made of aluminum; Place the sample material container on a holder unit; Set the sample material container in an electric furnace; Heat the sample in nitrogen atmosphere from 20° to 150° C. at a rising rate of 10° C./min; Measure DSC curve thereof using the differential scanning calorimeter system (DSC-60, manufactured by Shimadzu Corporation); and calculate the glass transition temperature from the intersection point of the tangent of the curve before the flexion point of the resin or the toner and the tangent of the curve after the flexion point thereof using the analysis program installed in the DSC-60 system. In addition, from the peak value deriving from the plasticizer, the melting point (Tm) of the plasticizer can be obtained. When the melting point of the plasticizer matches the peak of another substance such as resin and wax in the toner, the melting point of the plasticizer can be obtained by performing DSC measurement for the simple plasticizer.

The glass transition temperatures (Tg2r and Tg2t) of the resin and the toner for the second temperature rise can be obtained by cooling down the sample thereof from 150° C. to 0° C. at a declining rate of 10° C./min after the first temperature rise mentioned above, heating the sample in nitrogen atmosphere to 150° C. at a rising rate of 10° C./min, and calculating DSC curve thereof with differential scanning calorimeter (DSC-60, manufactured by Shimadzu Corporation). These glass transition temperatures can be obtained from the obtained DSC curve by calculating the glass transition temperature from the intersection point of the tangent of the curve before the flexion point of the resin (or the toner) and the tangent of the curve after the flexion point thereof using the analysis program installed in the DSC-60 system. The endotherm peak deriving from the plasticizer disappears or diminishes because the resin and the plasticizer are dissolved in each other. The compatibility between the resin and the plasticizer can be obtained from the change in the area of the endotherm peak.

Other Components

There is no specific limit to the other components mentioned above. Therefore, such other components can be selected based on the desired purpose. Specific examples thereof include one or more colorants, waxes, charge control agents, inorganic particulates, fluidity improvers, cleaning improvers, magnetic materials, and metal soaps.

There is no specific limit to such colorants. Known dyes and pigments can be selected to purpose such as hue angle, color saturation, lightness, antiweatherability, transparent sheet transparency, and dispersability in toner. Specific examples thereof include carbon black, Nigrosine dyes, black iron oxide, yellow dyes, magenta dyes, and cyan dyes. Specific examples of such yellow dyes include condensation azo compounds, isoindolinone compounds, anthraquinone compounds, azo metal complexes, methyine compounds, and allylamide compounds. More specific examples of such yellow dyes include Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, C.I. pigment yellow, 12, 13, 14, 15, 17, 62, 74, 83, 93, 94, 95, 109, 110, 111, 128, 129, 147, 168 and 180. Specific examples of such magenta dyes include condensation azo compounds, diketopyrolo-pyrole compounds, anthraquinone compounds, quinacridone compounds, basic dye lake compounds, naphthol compounds, benzimidazolon compounds, thioindigo compounds, and perylene compounds. More specific examples of such magenta dyes include red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B., Brilliant Scarlet G, LITHOL RUBINE GX, Permanent Red F5R, Brilliant Carmine 6B, Pigment Scarlet 3B, Bordeaux SB, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, C.I. pigment red 2, 3, 5, 6, 7, 23, 48:2, 48:3, 48:4, 57:1, 81:1, 122, 146, 166, 169, 177, 184, 185, 202, 206, 220, 221 and 254. Specific cyan dyes include copper phthalocyanine compounds and their derivatives, anthraquinone compounds, basic dye lake compounds. More specific examples of such cyan dyes include cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, C.I. pigment blue 1, 7, 15, 15:1, 15:2, 15:3, 15:4, 60, 62 and 66.

These materials can be used alone or in combination.

There is no specific limit to the content of such a colorant. The content thereof can be suitably selected to purpose but is preferably from 1 to 15 weight % and more preferably from 3 to 10 weight %. When the content of such a colorant is too small, the coloring ability of toner containing the colorant may deteriorate. When the content thereof is too large, the dye may be not sufficiently dispersed in toner, which leads to deterioration of the coloring ability and the electric characteristics of the toner.

The colorant can be used as a master batch mixed with a resin. There is no specific limit to such a resin. Known resins can be suitably selected to purpose. Specific examples thereof include styrene, polymers of substitution products thereof, styrene based copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rhodine, modified rhodines, terpene resins, aliphatic hydrocarbon resins, aromatic petroleum resins, chlorinated paraffin, and paraffin waxes. These can be used alone or in combination.

Specific examples of the styrenes and polymers of substitution products thereof include polyester resins, polystyrenes, poly-p-chlorostyrene, and polyvinyltoluene. Specific examples of the styrene based copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethylacrylate copolymers, styrene-butylacrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batch mentioned above can be typically prepared by mixing and kneading the resin for use in the master batch and the colorant upon application of high shear stress thereto. It is preferred that an organic solvent should be used to boost the interaction between the colorant and the resin. In addition, a flushing method is preferred because the resultant wet cake of the colorant can be used as it is without drying. In such a flushing method, an aqueous paste including a colorant is mixed or kneaded with a resin solution of an organic solvent to transfer the colorant to the resin solution and remove the aqueous liquid and organic solvent component. In this case, a high shear stress dispersion device such as a three-roll mill is preferably used for mixing or kneading.

There is no specific limit to the waxes mentioned above. The waxes can be suitably selected to purpose. It is preferred to use a wax having a low melting point, i.e., from 50° C. to 120° C., since waxes having a low melting point effectively function between a fixing roller and the surface boundary of toner when dispersed with the resin. Therefore, such a wax having a low melting point has a good anti-hot offset property even for an oilless fixing, in which a wax such as oil is not applied to a fixing roller.

Specific examples of such waxes include natural waxes such as plant waxes such as carnauba wax, cotton wax, haze wax, and rice wax, animal waxes such as yellow bees wax and lanoline, mineral waxes such as ozokerite and petroleum waxes such as paraffin, microcrystalline wax and petrolatum. Other than these natural waxes, synthetic hydrocarbon waxes such as Fisher-Tropsch wax and polyethylene wax, and synthetic waxes such as esters, ketons, and ethers can be used. Further, fatty acid amides such as 1,2-hydroxystearic acid amide, stearic acid amides, anhydrous phthalic acid imides and chlorinated hydrocarbons, homo polymers or copolymers (e.g., copolymers of n-staryl acrylate-ethylmethacrylate) of a polyacrylate, which is a crystalline polymer resin having a relatively low molecular weight, such as poly-n-stearyl methacrylate and poly-n-lauric methacrylate, and crystalline polymers having a long chain alkyl group on its branched chain can be also used. These can be used alone or in combination.

There is no specific limit to the melting point of the waxes mentioned above. The melting point can be suitably selected to purpose. It is preferred that the melting point is from 50 to 120° C. and more preferably from 60 to 90° C.

When the melting point is too low, wax may have an adverse impact on heat-resistant preservability. When the melting point is too high, cold offset tends to occur at low temperature fixing.

Melt viscosity of the waxes mentioned above is preferably from 5 to 1,000 cps and more preferably from 10 to 100 cps when measured at a temperature 20° C. higher than the melting point of the wax mentioned above.

When the melting viscosity thereof is too small, the releasability may deteriorate. When the melting viscosity thereof is too large, the effect of the wax to improve anti-hot offset property and low temperature fixability may be insufficient.

There is no specific limit to the content of the wax mentioned above contained in the toner mentioned above. It is possible to suitably select any content to purpose. The content is preferably from 3 to 20 weight % and more preferably from 5 to 20 weight %.

When the content is too small, the releasability of the wax tends to be insufficient, resulting in deterioration of anti-offset property. When the content is too large, the fluidity of the toner easily deteriorates.

There is no specific limit to the charge control agent mentioned above. Any known charge control agents can be suitably selected to purpose.

Specific examples of the charge control agents include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphorous and compounds including phosphorous, tungsten and compounds including tungsten, fluorine-containing activators, metal salts of salicylic acid, metal salts of salicylic acid derivatives, etc. These can be used alone or in combination.

Marketed products of the charge control agents can be also used and specific examples thereof include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge control agent is not particularly limited because the content is determined depending on the species of the kind of the resin mentioned above, whether or not an additive is added, and toner manufacturing method (such as dispersion method) used. However, the content of the charge control agent is preferably from 0.1 to 10 parts by weight, and more preferably from 0.2 to 5 parts by weight, per 100 parts by weight of the binder resin contained in the toner.

When the content is too small, good charge controllability may not be obtained. When the content is too high, the toner has too large a charge quantity, and thereby the electrostatic force of a developing roller attracting the toner increases, resulting in deterioration of the fluidity of the toner and decrease of the image density of toner images.

The inorganic particulates mentioned above can be used as an additive to impart fluidity, developability and chargeability to toner particles.

There is no specific limit to the inorganic particulates. It is possible to suitably select any known inorganic particulate to purpose. Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

Specific examples of the silica mentioned above include dry type silica referred to as dry method type or fumed silica which is produced by evaporation phase oxidizing a halogenated silicon as silicic acid fine powder and wet type silica produced from liquid glass, etc. Among these, dry type silica having fewer silanol groups on the surface of or inside the silica fine powder and fewer $Na_2O$, $SO_3$—, etc., remaining after manufacturing.

In addition, in the case of the dry type silica, it is possible to obtain complex fine powder of the dry type silica mentioned above and a metal oxide by using, for example, another halogenated metal such as aluminum chloride and titanium chloride with a halogenated silicon and the complex fine powder can be used.

It is preferred that the inorganic particulate should have a primary particle diameter of from 5 nm to 2 μm, and more preferably from 5 nm to 500 nm.

In addition, it is preferred that the specific surface area of such an inorganic particulate measured by a BET method is from 20 to 500 $m^2/g$.

The specific surface area mentioned above follows BET method using a specific surface area measuring device (AUTOSORB1, manufactured by Yuasa Ionics Inc.). Nitrogen gas is adsorbed on the surface of a sample and the specific surface area is calculated by using BET multiple point method.

The content of the inorganic particulate in the toner mentioned above is preferably from 0.01 to 5% by weight, and more preferably from 0.01 to 2.0% by weight, based on the total weight of the toner.

The fluidity improvers mentioned above represent materials which have been subject to a surface treatment to improve their hydrophobic nature, thereby maintaining the fluidity and chargeability even under high humidity conditions. Specific examples thereof include silane coupling agents, silylation agents, silane coupling agents including a fluoroalkyl group, organic titanate coupling agents, aluminum coupling agents, silicone oils, modified silicone oils, etc. Silica and titanium oxide mentioned above are preferably surface-treated by such a fluidity improver and used as hydrophobic silica and hydrophobic titanium oxide.

The viscosity of the silicone oil mentioned above is, for example, preferably from 10 to 200,000 $mm^2/s$ and more preferably from 3,000 to 80,000 $mm^2/s$.

When the viscosity mentioned above is too small, the performance of the inorganic fine powder mentioned above tends to be unstable. In that case, image quality may deteriorate upon application of heat or mechanical stress. When the viscosity is too large, uniform hydrophobization treatment may be difficult.

Preferred specific examples of such silicone oils include, for example, dimethyl silicone oil, methyl phenyl silicone oil, α-methyl styrene modified silicone oil, chlorphenyl silicone oil, and fluorine modified silicone oil.

Specific examples of usages of such silicone oils include, for example, a method in which silica treated with a silane coupling compound and a silicone oil are directly mixed with a mixer such as a HENSCHEL mixer, a method in which a silicone oil is sprayed on silica, and a method in which, subsequent to dissolution and/or dispersion of a silicone oil in a desired solvent, silica powder is admixed in the solution and/or dispersion liquid and the solvent is removed. Among these methods, the method in which a spraying device is used is preferred in light of relatively less production of an agglomerate of the inorganic finr powder mentioned above.

The content of the silicone oil is, for example, preferably from 1 to 40 parts by weight and more preferably from 3 to 35 parts by weight based on 100 parts by weight of the silica mentioned above.

The cleaning improver mentioned above is added to the toner mentioned above to remove developer remaining after transfer on an image bearing member or a primary transfer medium. Specific examples thereof include fatty acid metal salts such as zinc stearate, calcium stearate, and stearic acid and polymer particulates such as polymethyl methacrylate particulates and polystyrene particulates prepared by a soapfree emulsification polymerization method. The polymer particulates preferably have a relatively narrow particle size distribution. Its volume average particle diameter is preferably from 0.01 to 1 μm.

The toner of the present invention can be prepared by known methods such as a suspension polymerization method, an emulsification polymerization method, and dissolution suspension method. For example, the toner can be obtained by emulsifying or dispersing a solution or dispersion liquid of a toner component in an aqueous material to prepare an emulsification or dispersion liquid followed by granulation of toner particles.

Suitably preferred toner of the present invention is toner obtained as follows: Emulsify or disperse a toner component at least containing a compound having an active hydrogen and a polymer reactive therewith in an aqueous medium; and react the compound having an active hydrogen and the polymer reactive therewith in the aqueous medium to produce particles at least having adhesive-base materials.

The temperature at which the toner of the present invention is manufactured is preferably from 10 to 100° C. and more preferably from 20 to 60° C. When the temperature for manufacturing the toner is too high, the resin and the plasticizer therein tend to be dissolved in each other upon application of heat, it is thereby impossible to have a good combination of low temperature fixability and heat-resistant preservability.

Below are the descriptions of a preferred embodiment of toner of the present invention.

Solution or Dispersion Liquid of Toner Component

The solution or dispersion liquid of a toner component is prepared by dissolving or dispersing the toner component mentioned above in a solvent.

There is no specific limit to the toner component as long as toner particles can be granulated. It is possible to suitably select any toner component to purpose. For example, such a toner component contains at least one of a compound having an active hydrogen group and polymer (prepolymer) reactive therewith, preferably the plasticizer mentioned above, and the other components mentioned above such as non-modified polyester resins, waxes, colorants and charge control agents, if desired.

The solution and the dispersion liquid of a toner component is preferred to be prepared by dissolving or dispersing the toner component mentioned above in the organic solvent mentioned above. The organic solvent is preferably removed during or after granulating toner particles.

There is no specific limit to the organic solvent as long as the toner component can be dissolved or dispersed therein. It is possible to suitably select any organic solvent to purpose. For example, a volatile organic solvent having a boiling point not higher than 150° C. is preferred in terms of removal. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. Among them an ester based solvent is preferred and ethyl acetate is particularly preferred. These can be used alone or in combination.

There is no specific limit to the addition quantity of such an organic solvent. It is possible to suitably select any addition quantity to purpose. For example, the addition quantity is preferably from 40 to 300 parts by weight, more preferably from 60 to 140 parts by weight, and further preferably from 80 to 120 parts by weight, per 100 parts by weight of the toner component.

In addition, in the method of preparing preferred toner of the present invention, a solution or dispersion liquid of the toner component can be prepared by dissolving or dispersing materials such as a compound having an active hydrogen group, a polymer reactive therewith, a non-modified polyester resin, a wax, a colorant, and a charge control agent in the organic solvent. Among the toner components mentioned above, the components other than the polymer (prepolymer) reactive with the compound having an active hydrogen group can be admixed in an aqueous medium during preparation of an aqueous medium described later, or added to an aqueous medium together with a solution or dispersion liquid of the toner component when the solution or the dispersion liquid is added to the aqueous medium.

The compound having an active hydrogen group functions as an elongation agent or cross-linkage agent when the compound having an active hydrogen group and a polymer reactive therewith perform elongation reaction, cross-linkage reaction, etc., in an aqueous medium.

There is no specific limit to the compound having an active hydrogen group as long as the compound has an active hydrogen group therein. It is possible to suitably select any compound to purpose. For example, when a polymer reactive with a compound having an active hydrogen group is a polyester prepolymer having an isocyanate group (A), amines (B) are preferred considering that these amines can perform reactions such as elongation reaction and cross-linkage reaction with the polyester prepolymer having an isocyanate group to obtain a resultant polymer having a large molecular weight.

There is no specific limit to the active hydrogen group and it is possible to select any group containing an active hydrogen to purpose. Specific examples of such active hydrogen groups include hydroxyl group (alcohol hydroxyl group and phenol hydroxyl group), amino group, carboxyl group and mercapto group. These groups can be used alone or in combination. Among them, alcohol hydroxyl group is especially preferred.

There is no specific limit to the amines (B) mentioned above and it is possible to suitably select them to purpose. Specific examples of the amines (B) include diamines (B1), polyamines (B2) having three or more amino groups, amino alcohols (B3), aminomercaptans (B4), amino acids (B5), and blocked amines (B6), in which the amines (B1-B5) mentioned above are blocked. These can be used alone or in combination. Among these, diamines (B1) and a mixture in which a diamine (B1) is mixed with a small amount of a polyamine (B2) having three or more amino groups are particularly preferred.

Specific examples of the diamines (B1) include aromatic diamines, alicyclic diamines and aliphatic diamines. Specific examples of the aromatic diamines include phenylene diamine, diethyltoluene diamine and 4,4'-diaminodiphenyl methane. Specific examples of alicyclic diamines include 4,4'-diamino-3,3'-dimethyldicyclohexyl methane, diaminocyclohexane and isophoron diamine. Specific examples of aliphatic diamines include ethylene diamine, tetramethylene diamine and hexamethylene diamine.

Specific examples of the polyamines (B2) having three or more amino groups include diethylene triamine, and triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) in which the amino group of B1 to B5 mentioned above is blocked include ketimine compounds which are prepared by reacting one of the amines (B1)-(B5) mentioned above with a ketone such as acetone, methyl ethyl ketone and methyl isobutyl ketone and oxazolizone compounds.

The elongation reaction and the cross-linkage reaction between the compound having an active hydrogen group and the polymer reactive therewith can be controlled by a molecular weight control agent. Such a molecular weight control agent is desired because the molecular weight, etc., of the adhesive base material mentioned above can be controlled within a desired range.

Specific preferred examples of the molecular-weight control agent include monoamines (e.g., diethyle amine, dibutyl amine, butyl amine and lauryl amine), and blocked amines (i.e., ketimine compounds) prepared by blocking the monoamines mentioned above.

The mixing ratio of the amines (B) to the prepolymer (A) having an isocyanate group, i.e., the mixing equivalent ratio ([NCO]/[NHx] of the isocyanate group [NCO] contained in the prepolymer (A) having an isocyanate group to the amino group [NHx] contained in the amines (B), is preferably from 1/3 to 3, more preferably from 1/2 to 2 and particularly preferably from 1/1.5 to 1.5. When the mixing ratio is too low, the low temperature fixability tends to deteriorate. When the mixing ratio is too large, the molecular weight of the urea modified polyester may decrease, resulting in deterioration of anti-hot offset property.

Polymer Reactive with Compound Having an Active Hydrogen Group

There is no specific limit to the polymer (hereinafter occasionally referred to as prepolymer) reactive with a compound having an active hydrogen group as long as the polymer has a portion reactive with the compound having an active hydrogen group. It is possible to suitably select any known resin. For example, polyol resins, polyacrylic resins, polyester resins, epoxy resins, and their derivative resins can be used.

These can be used alone or in combination. Among these, polyester resins are particularly preferred in terms of high fluidity and transparency when fused.

There is no specific limit to the portion in the prepolymer mentioned above reactive to a compound having an active hydrogen group. It is possible to suitably select any among known substituents, etc., to purpose. For example, isocyanate group, epoxy group, carboxylic acid, an acid chloride group can be mentioned These can be used alone or in combination. Among these, isocyanate group is particularly preferred.

Among these prepolymers mentioned above, a polyester resin (RMPE) having a urea linkage producing group is particularly preferred because such a prepolymer can easily control the molecular weight of the polymer component and secure oilless low temperature fixability, especially good releasability and fixability even when a mechanism to provide release oil to a heating medium for fixing is not provided.

An example of the urea linkage producing group is isocyanate group. When the urea linkage producing group in the polyester resin (RMPE) having a urea linkage producing group is isocyanate group, the polyester prepolymer (A) having an isocyanate group is a suitable example for the polyester resin (RMPE).

There is no specific limit to the polyester prepolymer (A) having an isocyanate group. It is possible to suitably select any polyester prepolymer (A) to purpose. A specific example of the polyester prepolymers (A) is a polyester prepared by reacting with a polyisocyanate (PIC) a polyester having an active hydrogen group which is a polycondensation compound of a polyol and a polycarboxylic acid.

There is no specific limit to the polyols (PO) mentioned above. It is possible to suitably select any polyol to purpose. Suitable polyols (PO) include diols (DIO) and polyols (TO) having three or more hydroxyl groups, and a mixture in which a diol (DIO) is mixed with a polyol (TO) having three or more hydroxyl groups. These can be used alone or in combination. Among these, a simple diol (DIO) or a mixture in which a diol (DIO) is mixed with a polyol (TO) having three or more hydroxyl groups is preferred.

Specific examples of the diols (DIO) include alkylene glycol, alkylene ether glycols, alicyclic diols, adducts of the alicyclic diols with an alkylene oxide, bisphenols and adducts of the bisphenols mentioned above with an alkylene oxide.

Suitably preferred alkylene glycols have 2 to 12 carbon atoms and their specific examples include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the adducts of the alicyclic diols with an alkylene oxide include compounds in which an alkylene oxide such as ethylene oxide, propylene oxide and butylene oxide is adducted to the alicyclic diols mentioned above. Specific examples of the bisphenols include bisphenol A, bisphenol F and bisphenol S. Specific examples of the adducts of the bisphenols with an alkylene oxide include compounds in which an alkylene oxide such as ethylene oxide, propylene oxide and butylene oxide is adducted to the bisphenols mentioned above.

Among these compounds, alkylene glycols having from 2 to 12 carbon atoms and adducts of a bisphenol with an alkylene oxide are preferred. Adducts of a bisphenol with an alkylene oxide, or mixtures of an adduct of a bisphenol with an alkylene oxide and an alkylene glycol having from 2 to 12 carbon atoms are particularly preferred.

Suitably preferred polyols (TO) having three or more hydroxyl groups have three to eight hydroxyl groups. Specific examples thereof include aliphatic alcohols having three or more hydroxyl groups, and polyphenols having three or more hydroxyl groups and adducts of a polyphenol having three or more hydroxyl groups with an alkylene oxide.

Specific examples of the aliphatic alcohols having three or more hydroxyl groups include glycerin, trimethylol ethane, trimethylol propane, pentaerythritol and sorbitol. Specific examples of the polyphenols having three or more hydroxyl groups include trisphenol PA, phenol novolak and cresol novolak. Specific examples of the adducts of a polyphenol having three or more hydroxyl groups with an alkylene oxide include adducts in which an alkylene oxide such as ethylene oxide, propylene oxide and butylene oxide is adducted to the polyphenols mentioned above having three or more hydroxyl groups.

The mixing ratio (DIO/TO) by weight of the diol (DIO) to the polyol (TO) having three or more hydroxyl groups in the mixture thereof is preferably from 10 to 10,000 and more preferably from 100 to 10,000.

There is no specific limit to the polycarboxylic acid (PC) and it is possible to suitably select any polycarboxylic acid to purpose. For example, dicarboxylic acids (DIC), polycarboxylic acids (TC) having three or more carboxyl groups, and a mixture in which a polycarboxylic acid (TC) is mixed with a dicarboxylic acid (DIC) can be mentioned. These can be used alone or in combination. Among these, a simple dicarboxylic acid (DIC) or a mixture in which a polycarboxylic acid (TC) having three or more carboxyl groups is mixed with a dicarboxylic acid (DIC) is preferred.

Specific examples of the dicarboxylic acids (DIC) mentioned above include alkylene dicarboxylic acids, alkenylene dicarboxylic acids, and aromatic dicarboxylic acids.

Specific examples of the alkylene dicarboxylic acids mentioned above include succinic acid, adipic acid and sebacic acid. The alkenylene dicarboxylic acids mentioned above preferably have 4 to 20 carbon atoms and specific examples thereof include maleic acid and fumaric acid. The aromatic dicarboxylic acids mentioned above preferably have 4 to 20 carbon atoms and specific examples thereof include phthalic acid, isophthalic acid, terephthalic acid and naphthalene dicarboxylic acids.

Among these, alkenylene dicarboxylic acids mentioned above having 4 to 20 carbon atoms and aromatic dicarboxylic acids having 8 to 20 carbon atoms are preferred.

Suitably preferred polycarboxylic acids (TC) having three or more carboxyl groups have three to eight carboxyl groups or more carboxyl groups. An example thereof is an aromatic polycarboxylic acid.

The aromatic polycarboxylic acids mentioned above preferably have 9 to 20 carbon atoms and specific examples thereof include trimellitic acid and pyromellitic acid.

Acid anhydrides or lower alkyl esters of any one selected from the dicarboxylic acids (DIC) mentioned above, the polycarboxylic acids (TC) mentioned above having three or more carboxyl groups, and the mixture mentioned above in which a polycarboxylic acid (TC) is mixed with a dicarboxylic acid (DIC) can be used as the polycarboxylic acids (PC) mentioned above. Specific examples of the lower alkyl esters mentioned above include methyl esters, ethyl esters and isopropyl esters.

There is no specific limit to the mixing ratio (DIC/TC) by weight of the dicarboxylic acid (DIO) to the polycarboxylic acid (TC) having three or more carboxyl groups in the mixture thereof and the mixing ratio can be determined to purpose and is preferably from 10 to 10,000 and more preferably from 100 to 10,000.

There is no specific limit to the mixing ratio (PO/PC) of the polyol (PO) to polycarboxylic acid (PC) when the polyol (PO) to polycarboxylic acid (PC) are subject to polycondensation. The equivalence ratio ([OH]/[COOH]) of hydroxyl group [OH] in the polyol (PO) to carboxyl group [COOH] in the polycarboxylic acid (PC) is preferably from 1 to 2, more preferably from 1 to 1.5 and particularly preferably from 1.02 to 1.3.

There is no specific limit to the content of the polyol (PO) in the polyester prepolymer (A) having an isocyanate group. It is possible to add any amount thereof to purpose. For example, the addition amount thereof is preferably from 0.5 to 40 weight %, more preferably from 1 to 30 weight OQ and particularly preferably from 2 to 20 weight %.

When the content of the polyol (PO) in the polyester prepolymer (A) having an isocyanate group is too small, the anti-hot offset property may deteriorate, which leads to difficulty in having a good combination of heat-resistant preservability and low temperature fixability of a toner. When the content thereof is too large, the low temperature fixability tends to deteriorate.

There is no specific limit to the polyisocyanate (PIC) mentioned above. It is possible to select any polyisocyanate (PC) to purpose. Specific examples thereof include aliphatic polyisocyanates, alicyclic polyisocyanates, aromatic diisosycantes, aromatic aliphatic diisocyanates, isocyanurates, and blocked polyisocyanates in which the polyisocyanates mentioned above are blocked with phenol derivatives thereof, oximes or caprolactams.

Specific examples of the aliphatic polyisocyanates include tetramethylene diisocyanate, hexamethylene diisocyanate, 2,6-diisocyanate methylcaproate, octamethylene diisocyanate, decamethylene diisocyanate, dodeca methylene diisocyanate, tetradeca methylene diisocyanate, trimethylhexane diisocyanate, and tetramethylhexane diisocyanate. Specific examples of the alicyclic polyisocyanates include isophorone diisocyanate and cyclohexylmethane diisocyanate. Specific examples of the aromatic didisocyanates include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate. Specific examples of the aromatic aliphatic diisocyanates include $\alpha,\alpha,\alpha',\alpha'$-tetramethyl xylylene diisocyanate. Specific examples of the isocyanurates include trisocyanato cycloalkyl-isocyanurate. These compounds can be used alone or in combination.

As to the mixing ratio of when the polyisocyanate (PIC) reacts with the polyester having an active hydrogen group (e.g., a polyester resin having a hydroxyl group), suitable mixing equivalence ratio ([NCO]/[OH]) of isocyanate group [NCO] in the polyisocyanate (PIC) to hydroxyl group in the polyester having a hydroxyl group is preferably from 1 to 5, more preferably from 1.2 to 4 and particularly preferably from 1.5 to 3.

When the equivalent ratio ([NCO]/[OH]) is too large, the low temperature fixability may deteriorate. When the equivalent ratio is too small, the anti-hot offset may deteriorate.

There is no specific limit to the content of the polyisocyanate (PIC) in the polyester prepolymer (A) having an isocyanate group. It is possible to desirably determine the content thereof. For example, the content is preferably from 0.5 to 40 weight %, more preferably from 1 to 30 weight % and further preferably from 2 to 20 weight %.

When the content of the polyisocyanate (PIC) in the polyester prepolymer (A) having an isocyanate group is too small, the anti-hot offset property may deteriorate, which leads to difficulty in having a good combination of heat-resistant preservability and low temperature fixability of a toner. When the content thereof is too large, the low temperature fixability tends to deteriorate.

The average number of isocyanate groups included in the polyester prepolymer (A) mentioned above having an isocyanate group is preferably not less than 1, more preferably from 1.2 to 1.5 and further preferably from 1.5 to 4.

When the average number of isocyanate groups is too small, the molecular weight of the polyester resin (RMPE), which is modified by the urea linkage producing group, may decrease, resulting in deterioration of anti-hot offset.

The weight average molecular weight (Mw) of the polymer reactive with the compound having an active hydrogen group is preferably from 3,000 to 40,000 and more preferably from 4,000 to 30,000 by molecular weight distribution by gel permeation chromatography (GPC) for portions soluble in tetrahydrofuran (THF). When the weight average molecular weight (Mw) is too small, the heat-resistant preservabiltiy may deteriorate. When the weight average molecular weight (Mw) is too large, the low temperature fixabiltiy may deteriorate.

For example, the molecular weight distribution based on gel permeation chromatography (GPC) can be measured as follows: Stabilize a column in a heat chamber at 40° C.; Flow tetrahydrofuran (THF) at this temperature at 1 ml/min as a column solvent; Fill 50 to 200 μl of a tetrahydrofuran sample solution of a resin which is prepared to have a sample density of 0.05 to 0.6 weight % for measurement. The molecular weight of the sample is calculated by comparing the molecular weight distribution of the sample with logarithm values and count values of the analytical curves obtained from several kinds of single dispersion polystyrene standard sample. Specific examples of the standard polystyrene samples for the analytical curves include polystyrenes having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, manufactured by Pressure Chemical Co., or Tosoh Corporation. It is preferred to use at least about ten standard polystyrene samples. Refractive index (RI) detectors can be used as the detector.

Aqueous Medium

There is no specific limit to the aqueous medium mentioned above. Any known aqueous media can be suitably selected. For example, water, solvents mixable with water, mixtures thereof can be used. Among theses water is particularly preferred.

There is no specific limit to the solvent mixable with water as long as the solvent can be mixed with water. Specific examples of such a solvent mixable with water include alcohols, dimethylformamide, tetrahydrofuran, cellosolves, and lower ketones.

Specific examples of the alcohols mentioned above include methanol, isopropanol and ethylene glycol. Specific examples of the lower ketones mentioned above include acetone and methyl ethyl ketone.

These can be used alone or in combination.

The aqueous medium mentioned above can be prepared by dispersing resin particulates in the aqueous medium. There is no specific limit to the addition amount of the resin particulates in the aqueous medium. It is possible to suitably determine the addition amount to purpose. For example, the addition amount is preferably from 0.5 to 10 weight %.

Suitable resins for use as the resin particulates include any known resins that can form an aqueous dispersion in an aqueous medium. Any known resin can be suitably selected to purpose. Specific examples of these resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins and polycarbonate resins. These resins can be used alone or in combination. Among these resins, at least one of vinyl resins, polyurethane resins, epoxy resins, and polyester resins is used to form resin particulates because an aqueous dispersion including fine spherical resin particles can be easily prepared.

Specific examples of the vinyl resins include polymers prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

In addition, it is possible to use a copolymer having a monomer having at least two unsaturated groups as the resin particulates mentioned above.

There is no specific limit to the monomers having at least two unsaturated groups and it is possible to suitably select any such monomer to purpose. Specific examples thereof include a sodium salt of an adduct of sulfuric ester with ethylene oxide methacrylate (ELEMINOL RS-30, manufactured by Sanyo Chemical Industries), divinyl benzene, and 1,6-hexane diol acrylate.

The resin particulates can be obtained through polymerization using a known method suitably selected to purpose. It is preferred to obtain an aqueous dispersion liquid of the resin particulates. Preferred specific example methods of preparing such aqueous dispersion liquid of the resin particulates include: (1) in the case of the vinyl resin mentioned above, a method in which an aqueous dispersion liquid of the resin particulate is directly prepared from a starting material, i.e., vinyl monomer, by polymerization reaction based on the polymerization method selected from any one of a suspension polymerization method, an emulsification polymerization method, a seed polymerization method and a dispersion polymerization method; (2) in the case of a polyaddition or polycondensation resin such as polyester resins, polyurethane resins and epoxy resins, a method in which a precursor such as monomer and oligomer or a solvent or solution thereof is dispersed in an aqueous medium under the presence of a desired dispersant and thereafter the resultant is cured by heat or a curing agent to prepare an aqueous dispersion body of a resin particulate; (3) in the case of a polyaddition or polycondensation resin such as polyester resins, polyurethane resins and epoxy resins, a method in which a desired emulsifier is dissolved in a precursor such as monomer and oligomer or a solvent or solution thereof (liquid is preferred. Heating is possible for liquidization) and thereafter an aqueous medium is added thereto for phase change emulsification; (4) a method in which a resin already prepared by any polymerization reaction such as addition polymerization, ring scission polymerization, polyaddition, addition condensation and condensation polymerization is pulverized by a mechanical rotation type or jet type fine pulverizer, the resultant is classified to obtain resin particulates, and the resultant is dispersed in an aqueous medium under the presence of a desired dispersant; (5) a method in which a resin already prepared by any polymerization reaction such as addition polymerization, ring scission polymerization, polyaddition, and condensation polymerization is dissolved in a solvent to obtain a resin solution followed by spraying the resin resolution to obtain resin particulates and the resin particulates are dispersed in an aqueous medium under the presence of a desired dispersant; (6) a method in which a resin already prepared by any polymerization reaction such as addition polymerization, ring scission polymerization, polyaddition, and condensation polymerization is dissolved in a solvent to obtain a resin particulate solution, a poor solvent is added thereto or resin particulates are precipitated by cooling the resin solution dissolved in the solvent by heating, the solvent is removed to obtain resin particulates and the resin particulates are dispersed in an aqueous medium under the presence of a desired dispersant; (7) a method in which a resin already prepared by any polymerization reaction such as addition polymerization, ring scission polymerization, polyaddition, addition condensation and condensation polymerization is dissolved in a solvent to obtain a resin solution, the resin solution is dispersed in an aqueous medium under the presence of a desired dispersant and the solvent is removed by heat or reducing pressure; and (8) a method in which a resin already prepared by any polymerization reaction such as addition polymerization, ring scission polymerization, polyaddition, addition condensation and condensation polymerization is dissolved in a solvent to obtain a resin solution, a desired emulsifier is dissolved therein, and an aqueous medium is added to perform phase change emulsification.

Emulsification and Dispersion

As for the emulsification and dispersion of a solution or a dispersion liquid of the toner component in the aqueous medium, it is preferred to disperse the solution or the dispersion liquid of the toner component in the aqueous medium while stirring. There is no specific limit to the dispersion methods. It is possible to suitably select any methods to purpose. For example, any known dispersion device can be used. Specific examples thereof include a low speed shearing type dispersion device and a high speed shearing type dispersion device.

In the toner manufacturing methods mentioned above, when the compound having an active hydrogen group and the polymer reactive therewith are subject to elongation reaction or cross-linkage reaction during the emulsification and dispersion mentioend above, an adhesive base material (the resin mentioned above) is produced.

Adhesive Base Material

The adhesive base material contains at least an adhesive polymer showing adhesiveness to a recording medium such as paper, which is prepared by reacting the compound mentioned above having an active hydrogen group and the polymer mentioned above reactive therewith in the aqueous medium mentioned above. The adhesive base material can further contain a binder resin suitably selected from known binder resins.

There is no specific limit to the weight average molecular weight of the adhesive base material mentioned above and it is possible to determine the weight average molecular weight thereof to purpose. For example, the weight average molecular weight is preferably not less than 3,000, more preferably from 5,000 to 1,000,000 and particularly preferably from 7,000 to 500,000.

When the weight average molecular weight is too-small, the anti-hot offset property may deteriorate.

There is no specific limit to the glass temperature (Tg) of the adhesive base material and it is possible to determine the glass temperature (Tg) thereof to purpose. The glass temperature (Tg) thereof is preferably from 30 to 70° C., and more preferably from 40 to 65° C. Since elongated polyester resins are co-existent in the toner mentioned above, the toner has a good preservability even when the glass transition temperature is relatively low in comparison with that of a typical polyester based toner.

When the glass transition temperature (Tg) is too low, the heat-resistant preservability of the toner may deteriorate. When the glass transition temperature (Tg) is too high, the low temperature fixability may be insufficient.

The glass transition temperature mentioned above can be measured by the following method in which, for example, TG-DSC system TAS-100 (manufactured by Rigaku Corporation) is used: Put about 10 mg of a toner in a sample container made of aluminum; Place the sample container on a holder unit; Set the holder unit in an electric furnace; Heat the electric furnace from room temperature to 150° C. at a rising rate of 10° C./min; Leave it at 150° C. for 10 minutes; Cool the sample to room temperature and leave it for 10 minutes; Thereafter, heat the sample to 150° C. at a decreasing rate of 10° C./min; Measure DSC curve by a differential scanning calorimeter (DSC); and, from the obtained DSC curve, calculate the glass transition temperature (Tg) from the intersection point of a tangent of the endothermic curve around the glass transition temperature (Tg) and the base line using the analysis system installed in TG-DSC system TAS-100 system.

There is no specific limit to the adhesive base material and it is possible to select any of them to purpose. Polyester based resins, etc., are especially preferred.

There is no specific limit to the polyester based resins mentioned above and it is possible to select any polyester based resin to purpose. Urea modified polyester based resins are particularly preferred.

The urea modified polyester based resins are obtained by reacting the amine (B) as a compound having an active hydrogen group with the polyester prepolymer (A) having an isocyanate group as a polymer reactive therewith in the aqueous medium mentioned above.

Other than a urea linkage, the urea modified polyester based resins mentioned above may contain a urethane linkage. There is no specific limit to the content mol ratio (urea linkage/urethane linkage) of the urea linkage and the urethane linkage. It is possible to be determined to purpose. The content mol ratio is preferably from 100/0 to 10/90, more preferably from 80/20 to 20/80, and particularly preferably from 60/40 to 30/70.

When the ratio of the urea linkage is too small, the anti-hot offset property may deteriorate.

Preferred specific examples of the urea modified polyester resins include (1) to (10). These are:

(1) a mixture of a polycondensation product of an adduct of bisphenol A with 2 mol of ethylene oxide and isophthalic acid, and a compound prepared by urea-modifying a polyester prepolymer with isophorone diamine, the polyester prepolymer being prepared by reacting a polycondensation product of an adduct of bisphenol A with 2 mol of ethylene oxide and isophthalic acid with isophorone diisocyanate;

(2) a mixture of a polycondensation product of an adduct of bisphenol A with 2 mol of ethylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide and isophthalic acid with isophorone diisocyanate;

(3) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(4) a mixture of a polycondensation product of an adduct of bisphenol A with 2 mol of propylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(5) a mixture of a polycondensation product of an adduct of bisphenol A with 2 mol of ethylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and terephthalic acid with isophorone diisocyanate;

(6) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(7) a mixture of a polycondensation product of an adduct of bisphenol A with 2 mol of ethylene oxide and terephthalic acid, and a compound prepared by urea-modifying a polyester prepolymer with ethylene diamine, the polyester prepolymer being prepared by reacting a polycondensation product of an adduct of bisphenol A with 2 mol of ethylene oxide and terephthalic acid with isophorone diisocyanate;

(8) a mixture of a polycondensation product of an adduct of bisphenol A with 2 mol of ethylene oxide and isophthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and isophthalic acid with diphenyl methane diisocyanate;

(9) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide, an adduct of bisphenol A with 2 mol of propylene oxide, terephthalic acid and dodecenyl succinic anhydride with diphenyl methane diisocyanate; and a mixture of a polycondensation product of an adduct of bisphenol A with 2 mol of ethylene oxide and isophthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and isophthalic acid with toluene diisocyanate.

Binder Resin

There is no specific limit to the binder resin mentioned above and it is possible to suitably select any binder resin to purpose. For example, polyester resins can be selected. Especially, non-modified polyester resins (un-modified polyester resins) are preferred.

The toner containing the non-modified polyester resins has a good low temperature fixability and gloss property.

As non-modified polyester resins, similar to the case of the polyester resins having urea linkage producing group, polycondensation products of polyols (PO) and polycarboxylic acids (PC) are mentioned. Part of the non-modified polyester resin is preferably dissolved to the polyester resin (RMPE) having a urea linkage producing group, meaning that both preferably have similar structures compatible to each other, in terms of low temperature fixaibility and anti-hot offset property.

The weight average molecular weight (Mw) of the non-modified polyester resin mentioned above is preferably from 1,000 to 30,000 and more preferably from 1,500 to 15,000 by molecular weight distribution by gel permeation chromatography (GPC) for portions soluble to tetrahydrofuran (THF). When the weight average molecular weight (Mw) is too small, the heat-resistant preservabiltiy may deteriorate. Therefore, as mentioned above, the content of the component having a weight average molecular weight (Mw) is desired to be 8 to 28% by weight. When the weight average molecular weight (Mw) is too large, the low temperature fixabiltiy may deteriorate.

The glass transition temperature of the non-modified polyester resin is preferably from 35 to 70° C. When the glass temperature mentioned above is too low, the heat-resistant preservability of toner may deteriorate. When the glass temperature is too high, the low temperature fixability thereof may deteriorate.

The hydroxyl value of the non-modified polyester resin is preferably not less than 5 mgKOH/g, preferably from 10 to 120 mgKOH/g and further preferably from 20 to 80 mgKOH/g. When the hydroxyl value is too small, the heat-resistance property and low temperature fixability may not be compatible.

The acid value of the non-modified polyester resin is normally from 1.0 to 30.0 mgKOH/g, and preferably from 5.0 to 20.0 mgKOH/g. In general, when the toner mentioned above has an acid value, the toner tends to be negatively charged.

When the toner mentioned above contains the non-modified polyester resin mentioned above, the mixture weight ratio (RMPE/PE) of the polyester based resin having a urea linkage producing group mentioned above (RMPE) and the non-modified polyester resin (PE) is preferably from 5/95 to 25/75 and more preferably from 10/90 to 25/75.

When the mixture weight ratio of the non-modified polyester resin (PE) is too large, the anti-hot offset property may deteriorate. When the mixture weight ratio of the non-modified polyester resin (PE) is too small, the low temperature fixability and gloss property of an image may deteriorate.

The content of the non-modified polyester resin in the binder resin mentioned above is, for example, preferably from 50 to 100 weight % and more preferably from 55 to 95 weight %. When the content is too small, the low temperature fixability and the strength and gloss property of a fixed image may deteriorate.

The adhesive base material, e.g., the urea modified polyester resin, can be prepared by, for example, the following methods:

(1) Emulsify or disperse in the aqueous medium mentioned above a solution or a dispersion liquid of the toner component mentioned above containing a polymer (e.g., the polyester prepolymer (A) mentioned above having an isocyanate group) reactive with the compound mentioned above having an active hydrogen group together with the compound mentioned above having an active hydrogen group (e.g., the amines (B)) to form the oil droplets mentioned above and perform elongation reaction and cross-linkage reaction of the polymer and the compound;

(2) Emulsify or disperse a solution or a dispersion liquid of the toner component mentioned above in the aqueous medium to which the compound mentioned above having an active hydrogen group is added beforehand to form the oil droplets mentioned above and perform elongation reaction and cross-linkage reaction of the polymer and the compound; and (3) Admix a solution or a dispersion liquid of the toner component mentioned above in the aqueous medium and then add the compound mentioned above having an active hydrogen group thereto to form the oil droplets mentioned above and perform elongation reaction and cross-linkage reaction of the polymer and the compound.

In the case of (3) mentioned above, modified polyester resins are preferentially produced on the surface of the toner prepared so that the concentration gradient can be laid in the toner particle.

There is no specific limit to the reaction conditions for producing the adhesive base material by the emulsification and the dispersion mentioned above. It is possible to suitably select conditions based on the combination of the compound mentioned above having an active hydrogen group and the polymer reactive therewith. The reaction time is preferably from 10 minutes to 40 hours and more preferably from 2 hours to 24 hours.

As a method of stably forming the dispersion body mentioned above containing a polymer (e.g., the polyester prepolymer (A) having an isocyanate group) reactive with the compound mentioned above having an active hydrogen group in the aqueous medium mentioned above, for example, there is a method in which a solution or a dispersion liquid of the toner component prepared by dissolving or dispersing in the organic solvent mentioned above the toner component mentioned above such as a polymer (e.g., the polyester prepolymer (A) having an isocyanate group) reactive with the compound mentioned above having an active hydrogen group, the colorant mentioned above, the wax mentioned above, the charge control agent mentioned above, the non-modified polyester resin mentioned above is added to the aqueous medium mentioned above to perform dispersion by shearing force.

The content of the aqueous medium mentioned above in the emulsification and dispersion mentioned above is preferably from 50 to 2,000 parts by weight and more preferably from 100 to 1,000 pasts by weight based on 100 parts by weight of the toner component.

When the content mentioned above is too small, the dispersion state of the toner component mentioned above is poor so that toner particles having a desired particle diameter are not obtained. When the content is too large, the production cost may increase.

In the emulsification and the dispersion mentioned above, a dispersant can be preferably used if desired to obtain a sharp particle size distribution with a desired particle form.

There is no specific limit to the dispersant and it is possible to suitably select any dispersant to purpose. Specific examples thereof include surface active agents, inorganic compound dispersants hardly soluble to water, and polymeric protective colloids.

These can be used alone or in combination. Among these, surface active agents are preferred.

As the surface active agents, there are anionic surface active agents, cationic surface active agents, nonionic surface active agents, and ampholytic surface active agents.

Specific examples of anionic surface active agents include alkylbenzene sulfonic acid salts, α-olefin sulfonic acid salts, and phosphoric acid esters. Among these, surface active agents having a fluoroalkyl group are preferred. Specific examples of the anionic surface active agents having a fluoroalkyl group include fluoroalkyl carboxylic acids having from 2 to 10 carbon atoms and their metal salts, disodium perfluorooctane sulfonylglutamate, sodium 3-{omega-fluoroalkyl (having 6 to 11 carbon atoms)oxy}-1-alkyl (having 3 to 4 carbon atoms) sulfonate, sodium 3-{omega-fluoroalkanoyl (having 6 to 8 carbon atoms)-N-ethylamino}-1-propanesulfonate, fluoroalkyl (having 11 to 20 carbon atoms) carboxylic acids and their metal salts, perfluoroalkylcarboxylic acids and their metal salts, perfluoroalkyl (having 4 to 12 carbon atoms) sulfonate and their metal salts, perfluorooctanesulfonic acid diethanol amides, N-propyl-N-(2-hydroxyethyl)perfluorooctanesulfone amide, perfluoroalkyl(having 6 to 10 carbon atoms)sulfoneamidepropyltrimethylainmonium salts, salts of perfluoroalkyl (having 6 to 10 carbon atoms)-N-ethylsulfonyl glycin, and monoperfluoroalkyl (having 6 to 16 carbon atoms) ethylphosphates.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents include amine salt type surface active agents and quaternary ammonium salt type anionic surface active agents. Specific examples of the amine salt type surface active agents include alkyl amine salts, amino alcohol fatty acid derivatives, polyamine fatty acid derivatives, and imidazoline. Specific examples of the quaternary ammonium salt type cationic surface active agents include alkyl trimethyl ammonium salts, dialkyl dimethyl ammonium salts, alkyl dimethyl benzyl ammonium salts, pyridinium salts, alkyl isoquinolinium salts, and benzetonium chloride. Among these, primary, secondary and tertiary aliphatic amines having a fluoroalkyl group, aliphatic quaternary ammonium salts such as perfluoroalkyl (having 6 to 10 carbon atoms) sulfoneamide propyltrimethy lammonium salts, benzalkonium salts, benzetonium chloride, pyridinium salts and imidazolinium salts. Specific examples of the marketed products of the cationic surface active agents include SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.); MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

Specific examples of the nonionic surface active agents include fatty acid amide derivatives, and polyalohol derivatives.

Specific examples of amopholytic surface active agents include alanine, dodecyldi(amino ethyl)glycine, di(octyl amonoethyl)glycine, and N-alkyl-N,N-dimethyl ammonium betaine.

An inorganic compound such as calcium phosphate, titanium oxide, colloidal silica, and hydroxyapatite can also be used as the inorganic compound dispersant hardly soluble to water.

Specific examples of the polymeric protective colloids include acids, (meth)acrylic monomer having a hydroxyl group, vinyl alcohol or ethers thereof, esters of vinyl alcohol and a compound having a carboxylic group, amide compounds or methylol compounds thereof, chlorides, homopolymers or copolymers having a nitrogen atom or a heterocyclic ring thereof, polyoxyethylene based compounds and celluloses.

Specific examples of the acids mentioned above include acrylic acid, methacrylic acid, α-cyanoacrylic acid, α-cyanomethacrylic acid, itaconic acid, crotonic acid, fumaric acid, maleic acid and maleic anhydride. Specific examples of the (meth) acrylic monomer mentioned above having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro- 2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of vinyl alcohols mentioned above or its ethers include vinyl methyl ether, vinyl ethyl ether and vinyl propyl ether. Specific examples of the esters mentioned above of vinyl alcohol and a compound having a carboxylic group include vinyl acetate, vinyl propionate and vinyl butyrate. Specific examples of the amide compounds mentioned above or their methylol compounds include acrylamide, methacrylamide and diacetone acrylamide acid and their methylol compounds. Specific examples of the chlorides mentioned above include acrylic acid chloride and methacrylic acid chloride. Specific examples of homopolymers or copolymers mentioned above having a nitrogen atom or a heterocyclic ring thereof include vinyl pyridine, vinyl pyrrolidone, vinyl imidazole and ethylene imine. Specific examples of the polyoxyethylene mentioned above include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the celluloses mentioned above include methyl cellulose, hydroxyethyl cellulose and hydroxypropyl cellulose.

It is possible to use a dispersion stabilizer in preparation of the dispersion liquid mentioned above.

Specific examples of the dispersion stabilizers include compounds such as calcium phosphate soluble in an alkali and an acid.

When the dispersion stabilizer is used, it is possible to remove calcium phosphate from particulates by a method of washing with water or a method of decomposing with enzyme after dissolving calcium phosphate with an acid such as hydrochloric acid.

When the dispersion liquid mentioned above is prepared, it is possible to use a catalyst for elongation and/or cross-linkage reaction. Specific examples thereof include dibutyltin laurate and dioctyltin laurate.

The organic solvent mentioned above is removed from the emulsified slurry obtained from the emulsification and/or dispersion.

The organic solvent can be removed by a method such as (1) a method in which the organic solvent mentioned above in the oil droplets mentioned above is completely evaporated by raising the temperature of the entire reaction system, and (2) a method in which an emulsified dispersion body is sprayed in dry atmosphere to form toner particulates by completely removing the non-water soluble organic solvent in the oil droplets to form toner particulates while evaporating and removing the aqueous dispersant together.

Toner particles are formed when the organic solvent mentioned above is removed. The toner particles can be washed, dried and so on and thereafter classified if desired. Such classification can be performed in the liquid by removing particulate portions using a cyclone, a decanter, or a centrifugal separator, or can be performed for powder toner particles obtained after drying.

The thus prepared toner powder particles can be mixed with other particles such as the colorants mentioned above, the waxes mentioned above, and the charge controlling agents mentioned above. Such fine particles can be fixed on and in the toner particles by applying a mechanical impact thereto. Thus the particles such as the waxes can be prevented from being detached from the surface of the toner particles.

Specific examples of such mechanical impact application methods include a method in which a mechanical impact is applied by a high speed rotation blade and a method in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Below is a description about toner prepared by the suspension polymerization method.

As mentioned above, the toner prepared by the suspension polymerization method can be obtained by preparing emulsion and/or dispersion liquid (suspension liquid) by emulsifying and/or dispersing a solution and/or dispersion liquid (suspension liquid) of a toner component in an aqueous medium followed by granulating toner particles. Solution and/or dispersion liquid of toner component In the suspension polymerization method mentioned above, the solution and/or the dispersion liquid mentioned above of the toner component is formed by dissolving, preferably the plasticizer mentioned above, a colorant, a wax, and, a charge control agent if desired in a polymeric monomer and an oil soluble polymerization initiator. In addition, if desired, it is possible to add an organic solvent, a polymer, a dispersant, etc., to reduce the viscosity of the polymer produced in the polymerization reaction described later.

Polymeric Monomer

Functional groups can be introduced onto the surface of a toner particle by using part of acids such as acrylic acid, methacrylic acid, α-cyano acrylic acid, α-cyano methacrylic acid, itaconic acid, fumaric acid, maleic acid and maleic anhydride, and acrylates and methacrylates having an amino group such as acryl amide, methacyl amide, diacetone acryl amide, their methylol compounds, vinyl pyridine, vinyl pyrolidone, vinyl imidazol, ethylene imine, and dimethyl amino ethyl methacrylate. In addition, when a dispersant having an acid group and a basic group is suitably selected, functional groups can be also introduced by absorbing the dispersant to remain on the surface of a toner particle.

Specific examples of the polymeric monomers include styrene based monomers such as styrene, o-methyl styrene, m-methylstyrene, p-methyl styrene, p-methoxy styrene and p-ethyl styrene, acrylic acid esters such as methyl acrylate, ethyl acrylate, n-butyl acrylate, isobutyl acrylate, n-propyl acrylate, n-octyl acrylate, dodecyl acrylate, 2-ethyl hexyl acrylate, steayl acrylate, 2-chloroethyl acrylate and phenyl acrylate, methacylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexylmethacrylate, stearylmethacrylate, phenyl methacrylate, dimetyl amino ethyl methacrylate, and dietyl amono ethyl methacrylate, ant other acrylonitriles, methacylonitriles and acrylic amides.

In addition, resins can be added to the polymeric monomers mentioned above. For example, since the polymeric monomers mentioned above are water soluble, the polymeric monomers are dissolved in an aqueous suspension liquid, meaning that emulsification polymerization is not performed. Therefore, when a polymeric monomer having a hydrophilic functional group such as an amino group, a carboxylic group, a hydroxyl group, a sulfone group, a glycidyl group and a nitrile group is desired to be introduced in toner, resins can be used which take a form of copolymers such as random copolymers, blocked copolymers and graft copolymers formed of such a polymeric monomer having a hydrophilic functional group and vinyl compounds such as styrene and ethylene, polycondensation such as polyesters and poly amides, and polyaddition polymers such as polyethers and polyimines.

The alcohol components and the acid components forming the polyester resin mentioned above are as follows:

Specific examples of the alcohol components include ethylene glycol, proplylene glycol, 1,3-butane diol, 1,4-butan diol, 2,3-butane diol, diethylne glycol, triethylene glycol, 1,5-pentane diol, 1.6-hexane diol, neopenthyl glycol, 2-ethyl-1,3-hexane diol, cyclohexane dimethnol, butene diol, octene diol, cyclohexene dimethanol, and hydrogenerated bisphenol A. In addition, polyols such as glycerine, pentaerythritol, sorbid, sorbitan, oxyalkylene ether of novolac type phenol resin can be used.

Specific examples of the acid components include carboxylic acids having two carboxyl groups and their anhydrides such as benzene dicarboxylic acid such as phthalic acid, terephthalic acid, and isophthalic acid and phthalic anhydride, alkyl dicarboxylic acids such as succinic acid, adipic acid, sebacic acid, and azelaic acid and their anhydrides, succinic acids substituted with an alkyl group or alkenyl group having 6 to 18 carbon atoms and their anhydrides, and unsaturated dicarboxylic acids such as fumaric acid, maleic acid, citraconic acid, and itaconic acid and their anhydrides. In addition, poly carboxylic acids such as trimellitic acid, pyromellitic acid, 1,2,3,4-betane tetra carboxylic acid, benzophenon tetracarboxulic acid and their anhydrides can be also used.

With regard to the content of the alcohol components mentioned above and the acid components mentioned above, the content of the alcohol component mentioned above is preferably from 45 to 55 mol % and the acid component mentioned above is preferably from 55 to 45 mol %.

The polyester resins mentioned above can be used in combination as long as the combination does not have an adverse effect on the physicality of the toner particle obtained. In addition, it is possible to control the physicality, for example, modification by a compound having silicon or a fluoroalkyl group.

When a polymer having such a polar functional group is used, the average molecular weight of the polymer is preferably not less than 5,000.

Further, in addition to the polymeric monomers mentioned above, the following resins can be used. These resins are: styrene and its substituted monopolymers such as poly styrene and polyvinyl toluene; styrene based copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate, styrene-dimethyl aminoethyl acrylate copolymers, styrene-methyl methacrylate copolymers, styrene-ethyl methacrylate copolymers, styrene-butyl methacrylate copolymers, styrene-dimethyl amino ethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleic acid ester copolymers; polymethyl methacrylate, polybutyl methacrylate, polyvinyl acetate resin, polyethylene, polypropylene, polyvinyl butyral, silicone resins, polyester resins, polyamide resins, epoxy resins, polyacrylic resins, rosin, modified rosins, terpene resins, phenol resins, aliphatic or alicyclic hydrocarbon resins and aromatic petroleum resins. These can be used alone or in combination.

The addition amount of these resins is preferably from 1 to 20 parts by weight based on 100 parts by weight of the polymeric monomer mentioned above. When the addition amount is too small, the addition effect of adjusting the physicality of toner particles may not be exercised. When the addition amount is too large, designing the physicality of toner particles may be difficult.

In addition, it is possible to dissolve and polymerize a polymer having a different molecular weight range from that of toner obtained by polymerizing the polymeric monomer mentioned above in the polymeric monomer mentioned above.

Oil Soluble Polymerization Initiator

When the oil soluble polymerization initiator mentioned above having a half period of 0.5 to 30 hours during polymerization reaction is added in an amount of 0.5 to 20 parts by weight based on 100 parts by weight of the polymeric monomer, a polymer having a peak between a molecular weight of 10,000 and 100,000 can be obtained. Thereby, a preferred strength and desired dissolution characteristics are imparted to the toner obtained.

There is no specific limit to the oil soluble polymerization initiators and it is possible to suitably select any oil soluble polymerization initiator to purpose. Specific examples thereof include azo-based or diazo-based polymerization initiators such as 2,2-azobis-isobutyronitrile, 1,1'-azobis-(cyclohexane-a-carbonitrile), 2,2' azobis-4-methoxy-2,4-dimethyl valeronitrile, and azobis-isobutyronitrile; and hyperoxidation polymerization initiators such as benzoil peroxide, methylethyl ketone peroxide, diisopropyl peroxy carbonate, cumene hydroperoxide, 2,4-dichlorobenzoyl peroxide, lauroyl peroxide, and t-butyl peroxy 2-ethyl hexanoate.

Aqueous Medium

There is no specific limit to the aqueous medium mentioned above and it is possible to suitably select any aqueous medium to purpose. For example, water can be used.

It is preferred for the aqueous medium mentioned above to contain a dispersion stabilizer.

Specific examples thereof include a known surface active agent, an organic dispersant, and an inorganic dispersant. Among these, inorganic dispersants are preferred in that the inorganic dispersants hardly produce harmful super fine particles, and can obtain dispersion stability according to steric hindrance. Further, such inorganic dispersants are stable to changes in reaction temperature and are easy to wash. Therefore, there is no adverse effect on toner.

Specific examples of the inorganic dispersants include polyvalent metal salts of phosphoric acid such as calcium phosphate, magnesium phosphate, aluminum phosphate and zinc phosphate, carbonates such as calcium carbonate and magnesium carbonate, inorganic salts such as calcium metasilicate, calcium phosphate and barium sulphate, and inorganic oxides such as calcium hydrate, magnesium hydrate, aluminum hydrate, silica, bentnite and alumina.

The inorganic dispersants can be used as they are. It is also possible to produce inorganic dispersant particles in the aqueous medium mentioned above to obtain finer particles thereof. For example, in the case of calcium phosphate mentioned above, it is possible to produce water insoluble calcium phosphate by mixing an aqueous solution of sodium phosphate with an aqueous solution of calcium chloride while vigorously stirring. Thereby, more uniform and finer dispersion is possible. During the mixing, sodium chloride soluble in water is produced as a by-product. Solution of the polymeric monomer mentioned above to water is limited under the presence of a water soluble salt in the aqueous medium. Thereby, superfine toner particles are hardly produced by emulsification polymerization, which is preferred. However, the by-product is a drawback when the remaining polymeric monomer is removed at the last stage of polymerization reaction. Therefore, it is preferred to exchange the aqueous medium or desalt with a deionization exchange resin. The inorganic dispersant mentioned above can be almost completely removed by dissolving the inorganic dispersant in an alkali or an acid after polymerization.

The inorganic dispersant mentioned above is preferred to be singly used in an amount of 0.2 to 20 parts by weight based on 100 parts by weight of the polymeric monomer mentioned above. When the inorganic solvent mentioned above is used, super fine particles are hardly produced but it is also difficult to obtain toner having a small particle diameter. Therefore, it is preferred to use a surface active agent in an amount of 0.001 to 0.1 parts by weight in combination.

Specific examples of the surface active agents include dodecyle benzene sodium sulfurate, tetradecyle sodium sulfurate, pentadecyle sodium sulfurate, octyl sodium sulfurate, sodiumoleate, sodium laurate, sodium stearate and kalium stearate.

Suspension

The suspension mentioned above is performed by emulsifying and/or dispersing a solution and/or dispersion liquid of the toner component mentioned above in which the toner component is uniformly dissolved and dispersed in the aqueous medium mentioned above. During suspension, when the solution is straightly dispersed to a desired toner particle size level using a high speed dispersion device such as a high speed stirrer and a supersonic dispersion device, toner having a sharp particle size distribution can be obtained.

The oil soluble polymerization initiator mentioned above can be added to the polymeric monomer when other additives are added or immediately before the solution and/or dispersion liquid of the toner component mentioned above is suspended in the aqueous medium mentioned above. In addition, the oil soluble polymerization initiator mentioned above dissolved in the polymeric monomer or a solvent can be also added while granulating toner, immediately after granulating toner, or before starting polymerization reaction.

Granulation

The granulation mentioned above is performed by polymerizing the polymeric monomer mentioned above.

The temperature in the polymerization reaction is, for example, not less than 40° C., and typically from 50 to 90° C. When polymerization is performed in the temperature range, the additives such as the wax mentioned above and the wax mentioned above, which are to be existent inside toner particles, can be encapsulated therein through precipitation by phase separation. To consume the remaining polymeric monomer, the reaction temperature is occasionally set to be in the range of from 90 to 150° C. However, as mentioned above, when heated to the melting point of the plasticizer mentioned above, the resin mentioned above and the plasticizer mentioned above are dissolved in each other. Therefore, it is desired to perform reaction at a temperature not higher than the melting point of the plasticizer mentioned above. Specifically, it is preferred to perform the reaction at a temperature not higher than 100° C.

In the granulation mentioned above, it is possible to use a seed polymerization method using the oil soluble polymerization initializer after further adsorbing the polymeric monomer mentioned above to the polymeric particles obtained. It is possible to dissolve and/or disperse a compound having a polarity in the adsorbed polymeric monomer.

After the polymerization reaction mentioned above, it is preferred to stir the resultant with a typical stirrer to prevent the particles from floating and settling therein to maintain the particle state.

Toner particles are obtained from the polymerized particles obtained after polymerization reaction mentioned above using a known method. Redundant active surface active agent mentioned above is removed by filtration and washing. Subsequent to drying, inorganic fine powder is mixed and toner particles are obtained when the inorganic fine powder is attached to the surface of the particle. In addition, it is preferred to classify the particles to remove coarse particles and fine particles.

There is no specific limit to the physicality such as form and size of the toner of the present invention and it is possible to determine the physicality thereof to purpose. Preferred physicalities thereof, for example, volume average particle diameter (Dv), ratio (Dv/Dn) of volume average particle diameter (Dv)/number average particle diameter (Dn), penetration, low temperature fixability, and offset non-occurring temperature are as follows.

The volume average particle diameter (Dv) of the toner mentioned above is from 3 to 8 μm and more preferably from 4 to 6 μm.

When the volume average particle diameter is too small, toner is fused and attached to the surface of carrier by stirring in an extended period of time when a double component developer is used, which leads to deterioration of chargeability of the carrier. In addition, in the case of a single component developer, filming of toner on a developing roller or toner fusion and adhesion on a member such as a blade to regulate the layer thickness of the toner easily occur. When the volume average particle diameter is too large, quality images are hard to obtain at a high definition. When toner contained in a developer is replenished, the particle diameter of the toner may significantly vary.

The ratio (Dv/Dn) of the volume average particle diameter (Dv) to the number average particle diameter (Dn) of a toner is preferably not greater than 1.30 and more preferably from 1.00 to 1.30.

When the ratio (Dv/Dn) of the volume average particle diameter (Dv) to the number average particle diameter (Dn) is too small, toner is fused and attached to the surface of carrier by stirring in an extended period of time when a double component developer is used, which leads to deterioration of chargeability of the carrier and degradation of cleanability. In addition, in the case of a single component developer, filming of toner on a developing roller or toner fusion and adhesion on a member such as a blade to regulate the layer thickness of the toner easily occur. When the ratio (Dv/Dn) of the volume average particle diameter (Dv) to the number average particle diameter (Dn) is too large, quality images are hard to obtain at a high definition. When toner in a developer is replenished, the particle diameter of the toner may significantly vary.

When the ratio (Dv/Dn) of the volume average particle diameter (Dv) to the number average particle diameter (Dn) is from 1.00 to 1.30, any of preservation stability, low temperature fixability, and anti-hot offset property of the toner are excellent. Especially, gloss property of an image is excellent when the toner is used in a full color photocopier, etc. When toner in a double component developer is replenished over an extended period of time, the particle diameter of the toner varies relatively less. In addition, good and stable developability is obtained even for stirring in a developing device over an extended period of time. Further, when toner of a single component developer is replenished, the particle diameter of the toner varies relatively less, and filming of toner on a developing roller or toner fusion and adhesion on a member such as a blade to regulate the layer thickness of the toner does not occur. Good and stable developability is also obtained even for stirring in a developing device over an extended period of time so that quality images can be obtained.

The penetration mentioned above is preferably not less than 15 mm, and more preferably from 20 to 30 mm when the penetration is measured at the penetration test (JIS K2235-1991).

When the penetration mentioned above is too small, the heat-resistant preservability may deteriorate.

The penetration mentioned above can be measured following JIS K2235-1991. The specific method is as follows: toner is filled in a glass contained having 50 ml; the toner is left in a constant temperature bat at 50° C. for 20 hours; subsequent to cooling down the toner to room temperature; and penetration test is performed to measure the penetration thereof. The larger the penetration value is, the more excellent the heat-resistant preservability is.

With regard to the low temperature fixability, in terms of a good combination of decrease in fixing temperature and non-offset, the lower the allowable lowest fixing temperature is, the more preferable the low temperature fixability is, and the higher the non-offset temperature is, the more preferable the low temperature fixability is. The temperature range in which the decrease in the allowable lowest fixing temperature is compatible with non-offset is that the allowable lowest fixing temperature is lower than 150° C. and non-offset temperature is not lower than 200° C.

The allowable lowest fixing temperature is, for example, a temperature at a fixing roll below which the remaining ratio of the density of a fixed image is less than 70% after abrading the fixed image with a pad obtained in a photocopying test in which a transfer paper is set in an image forming apparatus.

The non-offset temperature can be determined by, for example, measuring a temperature at which offset does not occur for solid images of each single color of yellow, magenta, cyan, and black and intermediate colors of red, blue and green on a transfer paper set in an image forming apparatus while controlling to vary the temperature of the fixing belt.

There is no specific limit to the coloring of the present invention and it is possible to suitably select any color to purpose. These can be at least one color toner selected from black toner, cyan toner, magenta toner and yellow toner. Each color toner can be obtained by suitably selecting the kind of the colorants mentioned above.

The toner of the present invention has good characteristics such as fluidity and fixability and has an excellent combination of low temperature fixability and heat-resistant preservability. Therefore, the toner of the present invention can be suitably used in various kinds of fields and more suitably used in electrophotographic image formation. In addition, the toner of the present invention can be particularly suitably used in the following toner container, developer, process cartridge, image forming apparatus and image forming method.

Developer

A developer containing the toner of the present invention also contains suitably selected other components such as a carrier. The developer can be a single component developer or a two-component developer. When such a developer is used in a high speed printer, etc., capable of dealing with recent improvement on information processing speed, a two-component developer is preferred in terms of elongation of life thereof.

When the single component developer using the toner mentioned above of the present invention is replenished, the toner particle diameter varies relatively less and filming of the toner on a developing roller or toner fusion and adhesion on a member such as a blade to regulate the layer thickness of the toner does not occur. Therefore, good and stable developability and images can be also obtained even when the developer is used (i.e., stirred) in a developing device over an extended period of time. In addition, in the case of the two-component developer mentioned above using the toner of the present invention, when the toner is replenished over an extended period of time, the toner particle diameter varies relatively less. In addition, good and stable developability can be also obtained even when the developer is stirred in a developing device over an extended period of time.

There is no specific limit to the carrier mentioned above and it is possible to suitably select any known carrier to purpose. A carrier having a core material and a resin layer coating the core material is preferred.

There is no specific limit to the core material and it is possible to suitably select any known core material. For example, 50 to 90 emu/g of manganese-strontium (Mn—Sr) based material and manganese-magnesium (Mn—Mg) based material are preferred. In terms of securing image density, a strongly magnetized material such as iron powder (not less than 100 emu/g) and magnetite (75 to 120 emu/g) is preferred. In addition, in terms of advantage in improving quality of images due to weakening the contact of the toner forming filament between a photoreceptor, a weakly magnetized material such as a copper-zinc (Co—Zr) (30 to 80 emu/g) based material is preferred. These can be used alone or in combination.

The particle size of the core material mentioned above is preferably from 10 to 150 μm and more preferably from 40 to 100 μm as the volume average particle diameter.

When the average particle diameter (volume average particle diameter (D50) is too small, fine powder increases in carrier distribution. Thereby, magnetization per particle tends to be reduced, which leads to carrier scattering. When the average particle diameter (volume average particle diameter (D50) is too large, the specific surface area of toner tends to decrease, which leads to toner scattering. Thereby, reproduction of a full color image having a solid portion in a large ratio may deteriorate especially in the solid portion.

There is no specific limit to the materials for the resin layer mentioned above and it is possible to suitably select any known resin to purpose. Specific examples of such resins include amino-based resins, polyvinyl based resins, polystyrene based resins, halogenated olefin resins, polyester based resins, polycarbonate based resins, polyethylene resins, vinylidene polyfluoride resins, polytrifluoro ethylene resins, polyhexafluoro propylene resins, copolymers of vinylidene fluoride and an acrylic monomer, copolymers of vinylidene fluoride and vinyl fluoride, fluoroterpolymers such as terpolymers of tetrafluoroethylene, vinylidene fluoride and a non-fluoride monomer, and silicone resins. These can be used alone or in combination.

Specific examples of the amino based resins include urea-formaldehyde resins, melamine resins, benzoguanamine resins, urearesins, polyamideresins, and epoxy resins. In addition, specific examples of vinyl resins mentioned above include acrylic resins, polymethylmethacrylate resins, polyacrylonitirile resins, polyvinyl acetate resins, polyvinyl alcohol resins, and polyvinyl butyral resins. Specific examples of the polystyrene resins mentioned above include polystyrene resins, and styrene-acrylic copolymer resins. Specific examples of halogenated olefin resins mentioned above include polyvinyl chloride. Specific examples of the polyester resins mentioned above include polyethylene terephthalate resins and polybutylene terephthalate resins.

The resin layer mentioned above can contain electroconductive powder and so on if desired. Specific examples of such electroconductive powder include metal powder, carbon black, titanium oxide, tin oxide, and zinc oxide. These electroconductive powders preferably have an average particle diameter of not greater than 1 μm. When the average particle diameter is too large, the electric resistance thereof can be hard to control.

The resin layer mentioned above can be formed, for example, as follows: dissolve the silicone resin mentioned above in a solvent to prepare a coating liquid; uniformly apply the coating liquid to the surface of the core material mentioned above by a known applying method; and subsequent to drying, the surface is baked. Specific examples of the applying methods include a dip coating method, a spraying method, and a brushing method.

There is no specific limit to the solvent mentioned above and it is possible to suitably select any solvent to purpose. Specific examples thereof include toluene, xylene, methyl-ethyl ketone, methyl isobutyl ketone, and cellosol butyl acetate.

There is no specific limit to the baking mentioned above. External or internal heating can be taken. Specific examples thereof include a method using a fixed type electric furnace, fluidized electric furnace, a rotary type electric furnace or burner furnace, and a method using a microwave.

The content of the carrier mentioned above in the resin layer mentioned above is preferably from 0.01 to 5.0 weight %.

When the content thereof is too small, a uniform resin layer may not be formed on the surface of the core material mentioned above. When the content thereof is too large, the resin layer is too thick so that granulation of carrier particles occurs and uniform carrier particles may not be obtained.

When the developer mentioned above is the two-component developer mentioned above, the content of the carrier in the two-component developer has no specific limit and it is possible to suitably determine any content to purpose. The content thereof is preferably from 90 to 98 weight % and more preferably from 93 to 97 weight %.

A developer containing the toner of the present invention has good characteristics about, for example, fluidity and fixability. Quality images can be stably formed by using the developer while having low temperature fixability and heat-resistant preservability.

The developer can be suitably used in any known electrophotographic image formation such as a magnetic single component developing method, non-magnetic single component developing method and a two-component developing method. The developer can be particularly suitably used for a toner container accommodating the toner of the present invention, a process cartridge, an image forming apparatus and an image forming method.

Toner Container

A toner container accommodating the toner of the present invention contains the toner of the present invention or the developer mentioned above therein.

There is no specific limit to the toner container mentioned above and it is possible to suitably select any known container to purpose. For example, a toner container formed of the main body thereof and a cap can be suitably used.

There is no specific limit to the main body of the toner container in terms of the size, structure, and material. It is possible to suitably determine these to purpose. For example, the container can preferably have a cylindrical form. The cylindrical form preferably has spirally formed concave and convex portions in its inner surface. When the cylindrical form is rotated, the toner contained therein can move to the outlet side. Further, it is particularly preferred that the cylindrical form has an accordion type folding mechanism for part or the entire of the spiral portion.

There is no specific limit to the material of the main body of the toner container. A material having good dimension accuracy is preferred. For example, resins are preferred. Among these, polyester resins, polyethylene resins, polypropylene resins, polystyrene resins, polyvinyl chloride resins, polyacrylic resins, polycarbonate resins, ABS resins, and polyacetal resins are suitably mentioned.

The toner container is easy to preserve and move and has good handling property. The toner container can be detachably attached to a process cartridge, an image forming apparatus, etc., to suitably replenish toner.

A process cartridge includes at least a latent electrostatic image bearing member and a developing device to form a visualized image by developing the latent electrostatic image borne on the latent electrostatic image bearing member with developer. Further, other suitably selected device can be included in the process cartridge if desired.

The developing device mentioned above includes at least a developer container accommodating the toner of the present invention or the developer mentioned above, and a developer bearing member transferring the toner or the developer while bearing the toner or the developer accommodated in the developer container. Further, the developing device can have a layer thickness member to regulate the thickness of toner layer borne on the developer bearing member, etc.

A process cartridge can be detachably attached to various kinds of electrophotographic apparatuses and preferably to the image forming apparatus described later.

Image Forming Method and Image Forming Apparatus

An image forming method includes a latent electrostatic image forming process, a developing process, a transfer process and a fixing process, and preferably a cleaning process. Further, the image forming method can have suitably selected other processes such as a discharging process, a recycling process, and a controlling process if desired.

An image forming apparatus includes at least a latent electrostatic image bearing member, a latent electrostatic image forming device, a developing device, a transfer device and a fixing device and preferably a cleaning device. Further, the image forming apparatus can have suitably selected other devices such as a discharging device, a recycling device, and a controlling device if desired.

The image forming method can be suitably performed by the image forming apparatus mentioned above. The latent electrostatic image forming process can be performed by a latent electrostatic image forming device as mentioned above. The developing process can be performed by the developing device mentioned above. The transfer process can be performed by the transfer device mentioned above. The fixing process can be performed by the fixing device mentioned above.

Latent Electrostatic Image Formation Process and Latent Electrostatic Image Formation Device The latent electrostatic image forming process is a process in which a latent electrostatic image is formed on a latent electrostatic image bearing member.

There is no specific limit to the latent electrostatic image bearing member (can be referred to as photoconductive insulator or photoreceptor) about its material, form, structure, and dimension. It is possible to use any known image bearing member. A preferred form thereof is a drum form. Preferred material is, for example, inorganic substances such as amorphous silicon and selenium, and organic substances such as polysilane and phthalopolymethine. Among these, amorphous silicon is preferred in terms of life length.

The latent electrostatic image bearing member is formed by uniformly charging the surface of the latent electrostatic image bearing member and irradiating the surface imagewise by the latent electrostatic image forming device.

The latent electrostatic image forming device mentioned above includes at least, for example, a charging device to uniformly charge the surface of the latent electrostatic image bearing member and an irradiator to irradiate the surface of the latent electrostatic image bearing member.

The charging mentioned above can be performed by applying a voltage to the surface of the latent electrostatic image bearing member using the charging device mentioned above.

There is no specific limit to the charging device mentioned above. It is possible to select any charging device to purpose. Specific examples of such charging devices include a known contact type charging device having an electroconductive or semi-electroconductive roller, brush, film or rubber blade, and a non-contact type charging device such as corotron and scorotron using corona discharging.

The irradiation mentioned above can be performed by, for example, irradiating the surface of the latent electrostatic image bearing member imagewise with the irradiating device mentioned above.

There is no specific limit to the irradiating device mentioned above as long as the irradiating device can irradiate the surface of the latent electrostatic image bearing member charged by the charging device mentioned above imagewise. It is possible to suitably select any irradiating device to purpose. Specific examples of such irradiating devices include various kinds of irradiating devices such as a photocopying irradiator, a rod lens array irradiator, a laser optical irradiator, and a liquid crystal shutter optical irradiator. It is also possible to adopt an optical back face system in which imagewise irradiation is performed from the backside of a (the) latent electrostatic image bearing member mentioned above.

Developing Process and Developing Device

The developing process mentioned above is a process in which the latent electrostatic image mentioned above is developed with the toner of the present invention or the developer mentioned above by the developing device mentioned above.

There is no specific limit to the developing device as long as development can be performed with the toner of the present invention or the developer mentioned above. It is preferred to use a developing device including at least a development unit accommodating the toner of the present invention or the developer mentioned above and providing the toner or the developer to the latent electrostatic image while in contact with or not in contact with the image. It is more preferred for the development unit to include the toner container mentioned above.

The development unit mentioned above can be for dry type or wet type development. In addition, the development unit can be a mono-color development unit or a multi-color development unit. For example, the development unit preferably has a stirrer to charge the toner or the developer mentioned above by abrasively stirring and a rotatable magnet roller.

In the development unit, for example, the toner and the carrier are mixed and stirred to abrasively charge the toner and the toner is borne on the surface of the magnet roller while forming a magnet brush having a form of filament. Since the magnet roller is disposed in the vicinity of the latent electrostatic image bearing member (photoreceptor), part of the toner forming the magnet brush formed on the surface of the magnet roller transfers to the surface of the latent electrostatic image bearing member (photoreceptor) due to the electric attractive force. As a result, the latent electrostatic image is developed with the toner and a visualized image is formed on the surface of the latent electrostatic image bearing member (photoreceptor).

The developer accommodated in the development unit is a developer containing the toner of the present invention. The developer can be a single-component developer or a two-component developer. The toner contained in the developer is the toner of the present invention.

Transfer Process and Transfer Device

The transfer process mentioned above is a process in which the visualized image mentioned above is transferred to a recording medium. It is preferred that the visualized image is primarily transferred to an intermediate transfer body and thereafter secondarily transferred to the recording medium. Further, it is more preferred that two-color toner, preferably a full color toner, is used as the toner while the visualized image is primarily transferred to an intermediate transfer body and thereafter secondarily transferred to the recording medium.

The transfer can be performed by, for example, charging the latent electrostatic image bearing member (photoreceptor) with a transfer charging device for the visualized image using the transfer device. The transfer device preferably has a primary transfer device to form a complex transfer image by transferring a visualized image to an intermediate transfer body and a secondary transfer device to transfer the complex transfer image to a recording medium.

There is no specific limit to the intermediate transfer body and it is possible to suitably select any transfer body. For example, a transfer belt, etc., can be preferably used.

The transfer device (the primary transfer device and the second transfer device mentioned above) preferably has a transfer unit to charge the latent electrostatic image bearing member (photoreceptor) to detach the visualized image thereon to the recording medium. The transfer device can be alone or multiple.

Specific examples of the transfer units include a coroner transfer unit based on corona discharging, a transfer belt, a transfer roller, a pressure transfer roller, and adhesive transfer unit.

In addition, there is no specific limit to the recording media, and any known recording media (recording paper) can be suitably selected.

Fixing Process and Fixing Device

The fixing process mentioned above is a process in which a visualized image transferred to a recording medium is fixed with the fixing device. The fixing can be performed every time each color toner image is transferred to a recording medium or at once after each color toner is accumulated.

There is no specific limit to the fixing device and it is possible to suitably select any known fixing device to purpose. Known heat and pressure type fixing devices are preferred. Such a heat and pressure type fixing device can have, for example, a combination such as a heating roller and a pressing roller, and a heating, roller, a pressing roller and an endless belt.

Heating temperature in the heat and pressure device is preferably from 80 to 200° C.

In addition, in the present invention, for example, known optical fixing devices can be used together with or instead of the fixing process and the fixing device in the fixing process.

The discharging process mentioned above is a process in which a discharging bias is applied to the latent electrostatic image bearing member mentioned above for discharging.

There is no specific limit to the discharging device mentioned above. As long as the discharging device can apply a discharging bias to the latent electrostatic image bearing member, any known discharging device can be suitably selected. For example, a discharging lamp is suitably used.

The cleaning process is a process in which the electorphotographic toner remaining on the latent electrostatic image bearing member is removed. This cleaning can be preferably performed by a cleaning device.

There is no specific limit to the cleaning device. As long as the electrophotographic toner remaining on the latent electrostatic image bearing member can be removed, any known cleaner can be suitably used. Preferred specific examples thereof include a magnetic brush cleaner, an electrostatic brush cleaner, a magnetic roller cleaner, a blade cleaner, a brush cleaner and a web cleaner.

The recycling process is a process in which the color toner removed in the cleaning process mentioned above is returned to the developing device for recycle use. This recycling can be performed by a recycling device.

There is no specific limit to the recycling device and any known transfer device, etc., can be used.

The controlling device mentioned above is a process of controlling each process and the controlling can be suitably performed by a controlling device.

There is no specific limit to the controlling device as long as the device can control the behavior of each device. Any controlling device can be suitably selected to purpose. For example, devices such as a sequencer and a computer can be used.

An embodiment of performing the image forming method of the present invention using an image forming apparatus is described with reference to FIG. 1. FIG. 1 is a diagram illustrating an image forming apparatus 100 having a photoreceptive drum 10 (hereinafter referred to as photoreceptor 10) functioning as the latent electrostatic image bearing member, a charging roller 20 functioning as the charging device, an irradiating device 30, and a developing device 40, an intermediate body 50, a cleaning device 60 having a cleaning blade, and a discharging lamp 70.

The intermediate body 50 is an endless belt which is designed to be able to move in the direction indicated by the arrow by three rollers 51 disposed inside which suspend the endless belt. Part of the three rollers 51 can function as a transfer bias roller applying a desired transfer bias (primary transfer bias) to the intermediate transfer body 50. A cleaning device 90 is disposed in the vicinity of the intermediate transfer body 50. In addition, a transfer roller 80 is disposed opposing the intermediate transfer body 50 as the transfer device mentioned above. A transfer bias can be applied to the transfer roller 80 to transfer (secondarily transfer) a developed image (toner image) to a transfer medium 95 as the final transfer material. Around the intermediate transfer body 50, a corona charging device 58 is provided between the contact portion of the photoreceptor 10 and the intermediate transfer body 50 and the contact portion of the intermediate transfer body 50 and the transfer medium 95 in the rotation direction of the intermediate transfer body 50.

The developing device 40 is formed of a developing belt 41 functioning as the developer bearing member, a black developing unit 45Bk, a yellow developing unit 45Y, a magenta developing unit 45M, and a cyan developing unit 45C provided around the developing belt 41. The black developing unit 45Bk has a developer containing portion 42K, a developer supplying roller 43K and a developing roller 44K. The yellow developing unit 45Y has a developer containing portion 42Y, a developer supplying roller 43Y and a developing roller 44Y. The magenta developing unit 45M has a developer containing portion 42M, a developer supplying roller 43M and a developing roller 44M. The cyan developing unit 45C has a developer containing portion 42C, a developer supplying roller 43C and a developing-roller-44C. The developing belt 41 is an endless belt and suspended over multiple belt rollers while part of the developing belt 41 is in contact with the photoreceptor 10.

In the image forming apparatus 100 illustrated in FIG. 1, the charging roller 20 uniformly charges the photoreceptor drum 10. The irradiating device 30 irradiates the photoreceptor drum 10 imagewise to form a latent electrostatic image. The latent electrostatic image formed on the photoreceptor 10 is developed by toner supplied from the developing device 40 to form a visualized image (toner image). The visualized image (toner image) is transferred (primarily transferred) to the intermediate transfer body 50 by a voltage applied by the roller 51 and further transferred (secondarily transferred) to the transfer medium 95. Consequently, a transferred image is formed on the transfer medium 95. Toner remaining on the photoreceptor 10 after transfer is removed by the cleaning device 60 and the charges on the photoreceptor 10 are temporarily discharged by the discharging lamp 70.

Figure 2:
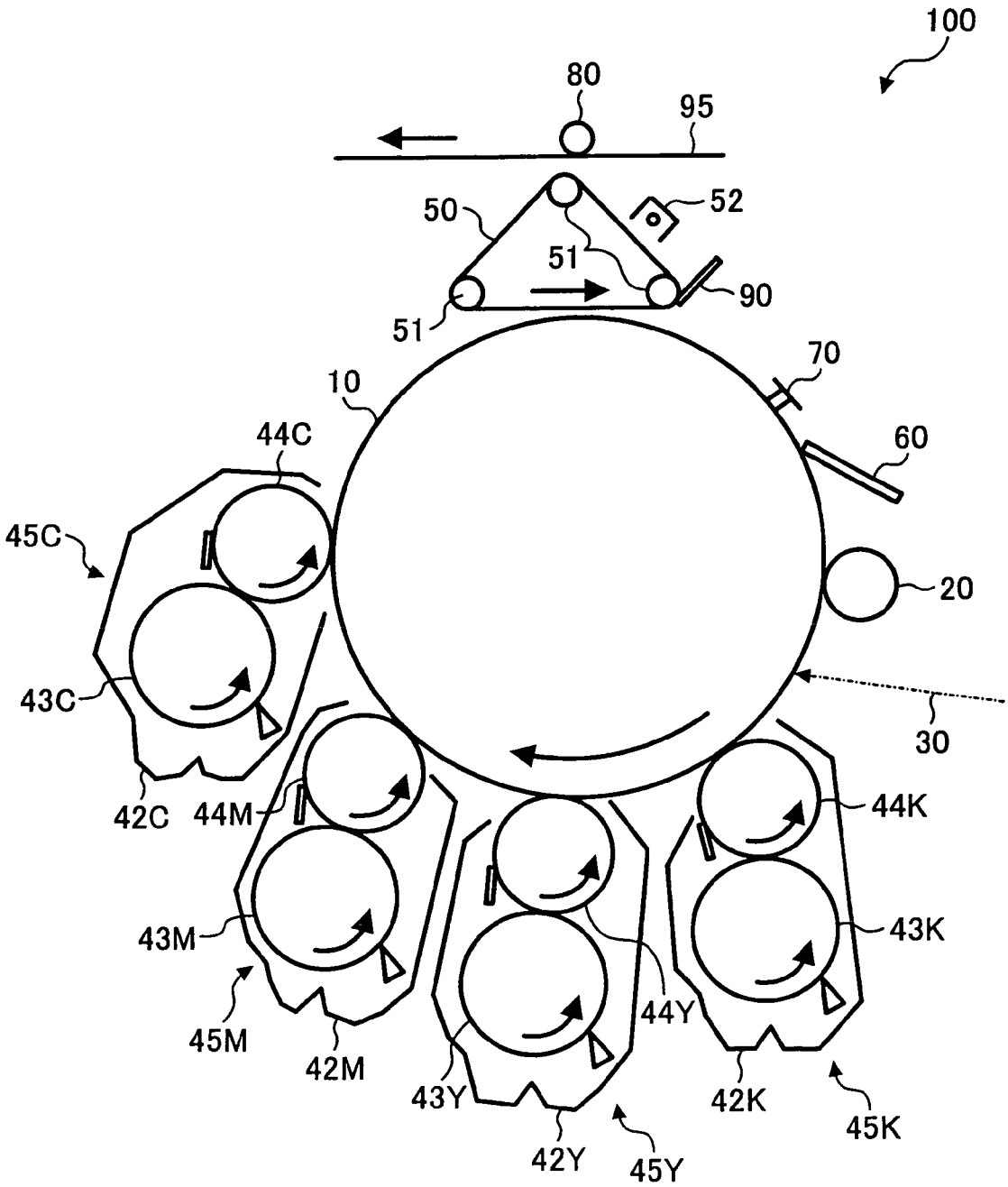
FIG. 2 is a schematic diagram illustrating another example of performing image formation by the image forming method of the present invention with an image forming apparatus.

Another embodiment of the image forming method of the present invention using an image forming apparatus is described with reference to FIG. 2. The image forming apparatus 100 illustrated in FIG. 2 has the same structure and the same effect as in the image forming apparatus 100 illustrated in FIG. 100 except that the developing belt 41 is not provided and the black developing unit 45K, the yellow developing unit 45Y, the magenta developing unit 45M, and the cyan developing unit 45C are directly disposed around the photoreceptor 100 opposing thereto. The same devices in FIG. 2 are illustrated by the same number as they are in FIG. 1.

Figure 3:
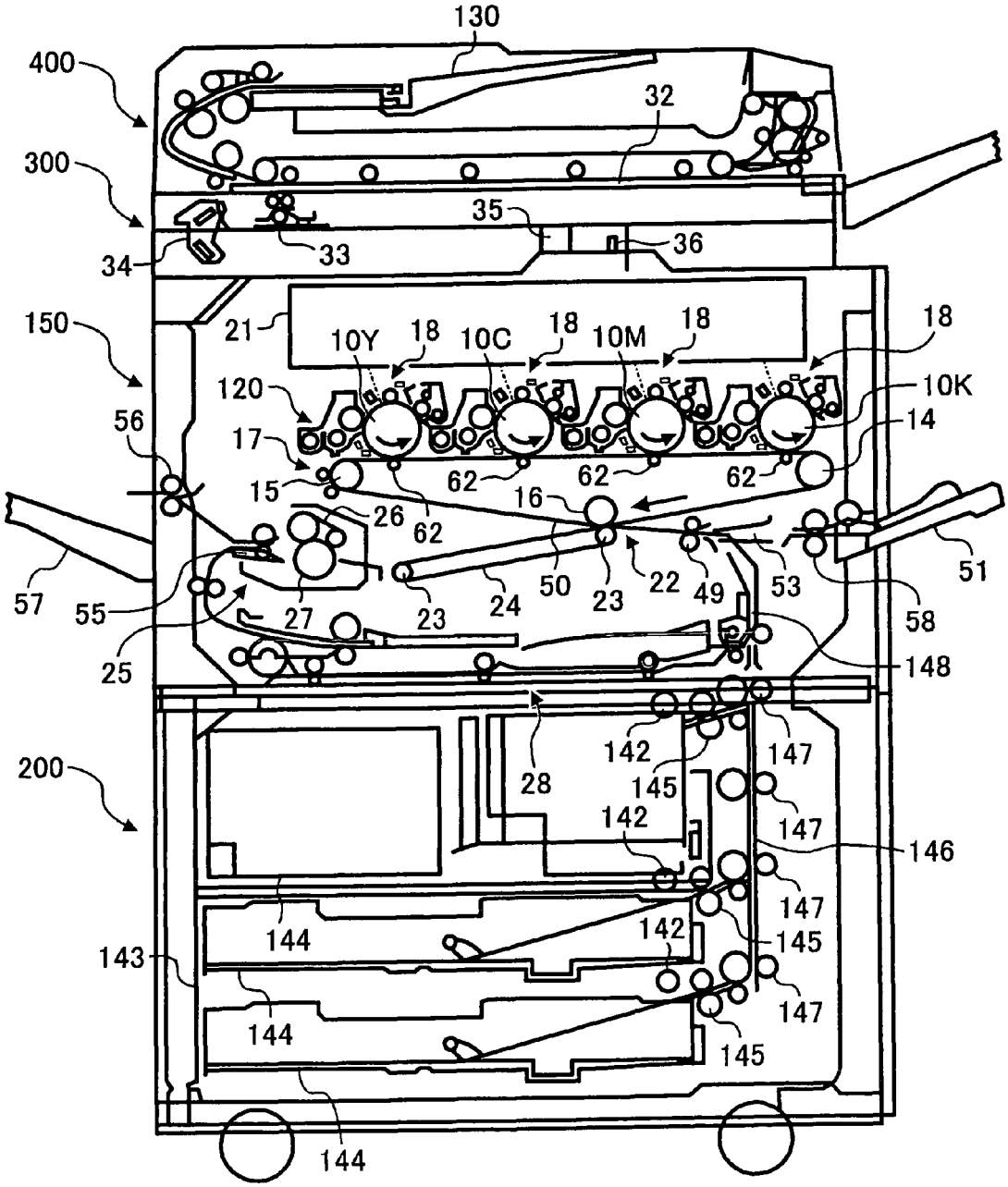
FIG. 3 is a schematic diagram illustrating an example of performing image formation by the image forming method of the present invention with an image forming apparatus (tandem type color image forming apparatus)

Yet another embodiment of the image forming method of the present invention using an image forming apparatus is described with reference to FIG. 3. The tandem type image forming apparatus 100 illustrated in FIG. 3 is a tandem type color image forming apparatus. The tandem type image forming apparatus 100 has a main body 150 of a photocopying device, a paper feeding table 200, a scanner 300 and an automatic document feeder (ADF) 400.

There is provided an intermediate body having an endless belt form in the center portion of the main body 150 of a photocopying device.

The intermediate transfer body 50 is suspended over supporting rollers 14, 15 and 16 and rotatable clockwise in FIG. 3. Around the supporting roller 15, there is provided an intermediate transfer body cleaning device 17 to remove toner remaining on the intermediate transfer body 50 in the vicinity of the supporting roller 15. In the portion of the intermediate transfer body 50 suspended over the supporting rollers 14 and 15, there is provided a tandem type developing unit 120 having four image forming devices 18 of yellow, cyan, magenta and black in this order in the transfer direction disposed opposing the intermediate transfer body 50. To the opposite side of the intermediate transfer body 50 on which the tandem type developing unit 120 is disposed, a secondary transfer device 22 is provided. In the secondary transfer device 22, a secondary transfer belt 24 having an endless belt form is suspended over a pair of rollers 23, and a transfer medium transferring on the secondary transfer belt 24 and the intermediate transfer body 50 can be in contact with each other. A fixing device 25 is provided in the vicinity of the secondary transfer device 22. The fixing device 25 has a fixing belt 26 having an endless belt form and a pressing roller 27 disposed while being pressed by the fixing belt 26.

In the tandem image forming apparatus 100 in FIG. 3, there is provided a sheet reversing device 28 of reversing a transfer medium to form images on both sides thereof in the vicinity of the secondary transfer device 22 and the fixing device 25.

Next, full color image formation (color photocopying) using the tandem type developing unit 120 is described. A color document is set on a document platform 130 on the automatic document feeder (ADF) 400, or on a contact glass 32 of a scanner 300 after opening the automatic document feeder (ADF) 400 and thereafter closing the automatic document feeder (ADF) 400.

When the starting switch (not shown) is pressed, the scanner 300 starts to operate a first scanning body 33 and a second scanning body 34 to scan the document after the document is transferred to the contact glass 32 in the case of the document being set on the automatic document feeder 400, or immediately in the case of the document being directly set on the contact glass 32. The first scanning body 33 irradiates the document with light from a power source and the mirror of the second scanning body 34 reflects the light reflected from the document. A reading sensor 36 receives the light through a focusing lens 35 and reads information of the color document (color image) to obtain the image information of black, yellow, magenta and cyan.

Each image information is relayed to each image formation device (black image formation device, yellow, magenta and cyan image formation device image formation device) in the tandem type developing unit 120. Each toner image of black, yellow, magenta and cyan is formed at each image forming device.

Figure 4:
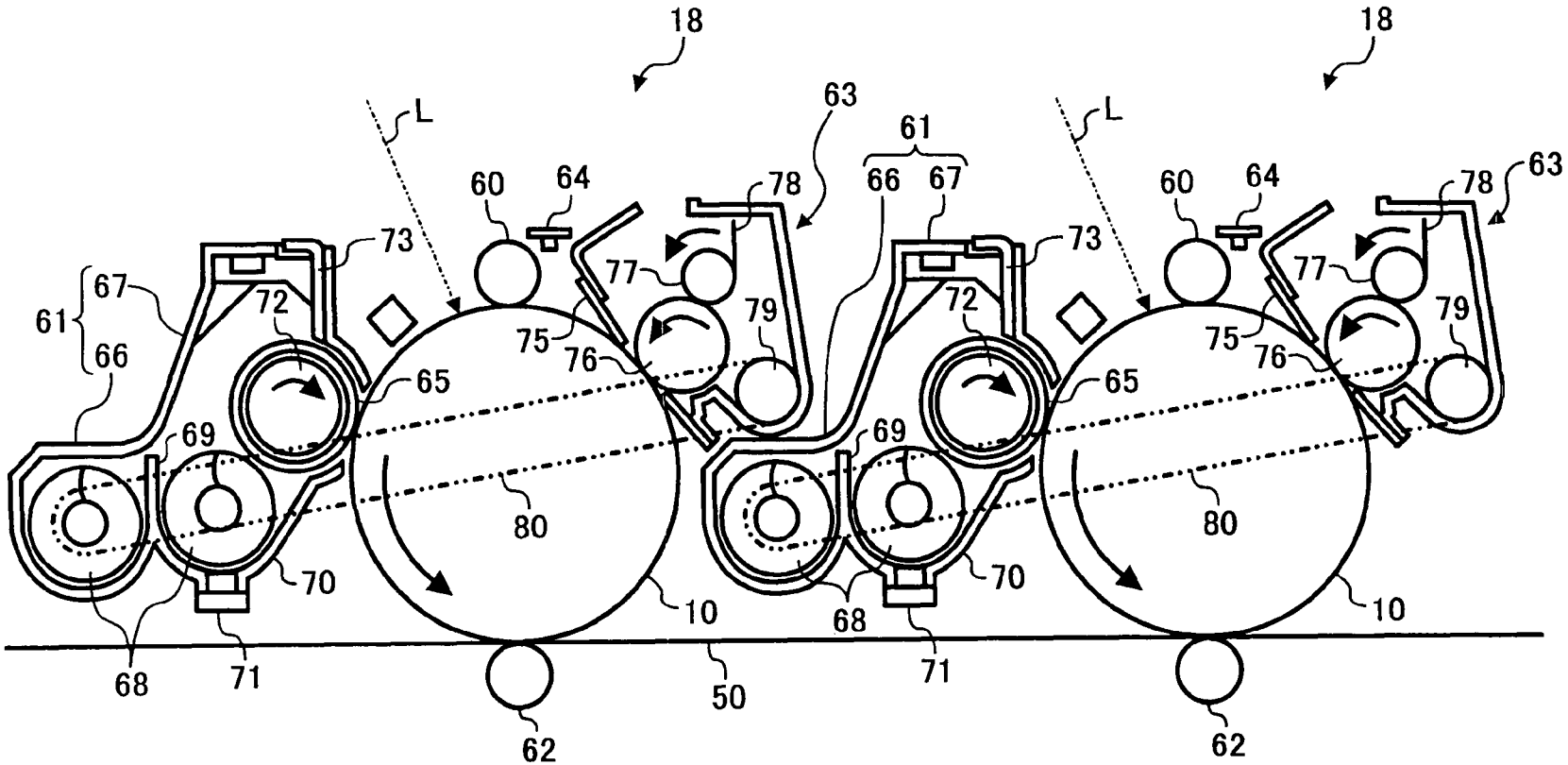
FIG. 4 is a diagram illustrating an enlarged portion of the image forming apparatus of FIG. 3.

As illustrated in FIG. 4, each image forming device 18 in the tandem type developing unit 120 (black image formation device, yellow, magenta and cyan image formation device image formation device) has the photoreceptor 10 (a photoreceptor 10K for black, a photoreceptor 10Y for yellow, a photoreceptor 10M for magenta, and a photoreceptor 10C for cyan), respectively. Further, each image forming device 18 includes a charging device 60 to uniformly charge the photoreceptors 10, an irradiating device to irradiate the photoreceptor 10 with imagewise light (L in FIG. 4) corresponding to each color image based on each color image information to form a latent electrostatic image corresponding to each color image on the photoreceptor 10 and the developing unit 61 to develop the latent electrostatic images with each color toner (black toner, yellow toner, magenta toner, and cyan toner) to form toner images of each color toner. Furthermore, each image forming device 18 includes a transfer charging device 62 to transfer the toner images to the intermediate transfer body 50, a photoreceptor cleaning device 62 and a discharging device 64. Each single color image (black color image, yellow color image, magenta color image and cyan color image) can be formed according to each color image information. The thus formed black color image, yellow color image, magenta color image and cyan color image formed on the photoreceptor 10K for black, the photoreceptor 10Y for yellow, the photoreceptor 10M for magenta, and the photoreceptor 10C for cyan, respectively, are transferred (primarily transferred) to the intermediate transfer body 50 rotatably movable by the supporting rollers 14, 15 and 16 in this order. The black image mentioned above, the yellow image mentioned above, the magenta image mentioned above and the cyan image mentioned above are overlapped on the intermediate transfer body 50 to form a synthesized color image (transferred color image).

In a paper feeder table 200, one of paper feeder rollers 142 is selectively rotated and sheets (recording paper) are fed from one of paper feeder cassettes 144 provided in a multi-stacking manner in a paper bank 143. A detaching roller 145 detaches paper one by one and feeds the paper to a paper feeding passage 148. The paper is blocked at a registration roller 49 and stops. Or sheets (recording paper) on a manually feeding tray 51 are fed by rotating a paper feeder roller 150 and detached one by one by a detaching roller 58. The paper is fed into a manually feeding passage 53, is blocked at the registration roller and stops. The registration roller 49 is typically used grounded but can be used when a bias to remove paper dust of sheets is applied.

The registration roller 49 is synchronously rotated to the synthesized color image (transferred color image) formed on the intermediate transfer body 50. A sheet (recording paper) is fed to between the intermediate transfer body 50 and the secondary transfer device 22. The secondary transfer device 22 transfers (secondarily transfers) the synthesized color image (transferred color image) to the sheet (recording paper) to form a color image thereon.

In addition, toner remaining on the intermediate transfer body 50 after transfer is removed by the intermediate transfer body cleaning device 17.

The sheet (recording paper) mentioned above on which the color image is transferred is transferred by the secondary transfer device 22 to the fixing device 25. In the fixing device 25, the synthesized color image (transferred color image) mentioned above is fixed on the sheet (recording paper) upon application of heat and pressure. Thereafter, the sheet (recording paper) is switched by a switching nail 55 and discharged by the discharging roller 56. The sheet is stacked on a discharging tray 57 or switched by the switching nail 55, reversed by the sheet reversing device 28 and returned to the transfer position to be ready for recording an image on its back side. After an image is formed on the back side thereof, the sheet is stacked on the discharging tray 57.

It is possible to suitably adopt the following adhesive transfer system in the image forming method of the present invention and an image forming apparatus.

When such an adhesive transfer system is adopted, the toner of the present invention contains at least a thermosensitive adhesive agent. Such a thermosensitive adhesive agent indispensably contains a solid plasticizer and a thermoplastic resin and optionally an adhesiveness imparting agent.

The thermosensitive adhesive agent does not have adhesiveness completely at room temperature. When the thermosensitive adhesive agent exercises adhesiveness upon application of heat or an external stress, and still maintains the adhesiveness for a while after the heat source is removed. The solid plasticizer mentioned above is fused upon application of heat. Thereby, the thermoplastic resin mentioned above and the adhesiveness imparting agent are also fused, resulting in appearance of adhesiveness. That is, the thermosensitive adhesive agent exercises its adhesiveness in a manner that the solid plasticizer is first thermally fused and compatibly dissolves the thermoplastic resin so that the plasticized thermoplastic resin becomes adhesive.

The image forming method of the present invention taking the adhesive transfer system includes at least a toner supplying process, a process of temporarily fixing a visualized image, and a thermally fusing and attaching process and optionally selected other processes such as a toner removing process if desired.

An image forming apparatus taking the adhesive transfer system includes at least an image bearing member, a toner supplying device, a device of temporarily fixing a visualized image, and thermally fusing and attaching device and optionally selected other processes such as a toner removing device if desired.

The image forming method of the present invention taking the adhesive transfer system is preferably performed by an image forming apparatus taking the adhesive transfer system. The toner supplying process mentioned above is performed by the toner supplying device mentioned above. The process of temporarily fixing a visualized image can be performed by the device of temporarily fixing a visualized image. The thermally fusing and attaching process can be performed by the thermally fusing and attaching device. The other processes mentioned above can be performed by the other devices mentioned above.

Toner Supplying Process and Toner Supplying Device

The toner supplying process is a process in which the toner of the present invention is supplied to the image bearing member mentioned above.

There is no specific limit to material, form, structure, dimensions, etc, of the image bearing member and any known image bearing member can be suitably selected. It is preferred to use an endless film formed of an optically transparent resin such as polycarbonate.

There is no specific limit to the toner supplying device. Any known toner supplying device can be suitably selected. For example, a toner supplying device is preferred which has a toner container to accommodate toner, a toner bearing member to transfer toner to the opposing portion of the image bearing member while bearing toner, a replenishing member to replenish toner in the container to the toner bearing member, and a layer thickness regulating member to uniform the layer thickness of toner on the toner bearing member.

Toner can be supplied to the toner bearing member mentioned above by imparting electrostatic attachment force or non-electrostatic attachment force such as magnetic force to the toner.

Process and Device of Temporarily Fixing Visualized Image

The process of temporarily fixing a visualized image is a process in which a visualized image is formed by toner portion contacting with the image bearing member mentioned above to which heat is applied according to image information, and the visualized image is temporarily fixed on the image bearing member mentioned above.

The device of temporarily fixing a visualized image preferably has an adhesiveness imparting device to impart adhesiveness to the toner mentioned above.

A preferred example of such an adhesiveness imparting device is a laser beam scanning device having a laser beam source, a collimator lens, a polygon mirror, an fθ lens, and a reflective mirror. The laser beam scanning device can provide heat imagewise to the toner mentioned above by laser beam according to image information. In addition, a thermal head can be used instead of laser beam.

The heat by the laser beam in the adhesiveness imparting device can selectively impart viscosity to toner existing on the place corresponding to the image portion on the toner bearing member. The toner to which heat has been applied forms a visualized image having a viscosity and the visualized image is temporarily fixed on the image bearing member.

This imparting of adhesiveness is applied to the case in which adhesiveness is imparted to a material originally having no viscosity and the case in which adhesiveness of an adhesive material is further improved.

The attachment force of the temporarily fixed visualized image on the image bearing member is weaker than the attachment force caused by electrostatic force formed between the toner and the toner image bearing member. In addition, the attachment force of the temporarily fixed visualized image on the image bearing member is as large as the force by which toner remaining on the image bearing member after transfer can be easily removed in the toner removing process described later.

Thermally Fusing and Attaching Process and Device

The thermally fusing and attaching process mentioned above is a process in which a temporarily fixed visualized image is thermally fused and attached to a recording medium and is performed by a thermally fusing and attaching device.

There is no specific limit to the thermally fusing and attaching device and it is possible to suitably select any device to purpose. A device capable of transferring and fixing the visualized image to the recording medium simultaneously is preferred and an example device thereof is a heat roller.

The toner removing process is a process in which toner existing on the portion other than the visualized image on the image bearing member is removed and is performed by a toner-removing device.

There is no specific limit to such toner removing devices. Any known cleaning device can be suitably selected as long as the toner remaining on an image bearing member can be removed. Specific examples thereof include a magnetic roller cleaner and a blade cleaner.

An embodiment of the image forming method using an image forming apparatus taking such adhesive transfer system is described with reference to FIG. 5. An image forming apparatus 500 illustrated in FIG. 5 includes an image bearing member 510, a toner supplying device 520 functioning as the toner supplying device, a laser beam scanning device 530 functioning as the adhesiveness imparting device in the device of temporarily fixing a visualized image, a toner removing roller 540 functioning as the toner removing device and a heating roller 550 functioning as the thermally fusing and attaching device.

The image bearing member 510 has an endless film form and is formed of polycarbonate as an optically transparent resin film through which light having a desired wavelength range passes. The thickness thereof is from 0.02 to 0.2 mm. The image bearing member 510 is designed to move in the direction of A indicated by the arrow by a roller 511 or 512 which is rotationally driven by a driving force such as a motor. The rollers 511 and 512 are disposed inside the image bearing member 510 while suspending the image bearing member 510. In addition, a cleaning device 514 is disposed in the vicinity of the roller 512 and has a cleaning roller 513 which is in contact with the roller 512 with the image bearing member 510 therebetween. Further, a blade 515 is disposed in contact with the cleaning roller 513.

The toner supplying device 520 is disposed in the vicinity of the image bearing member 510 and has a toner case 521 accommodating toner T, a toner bearing roller 522 to transfer toner T to the portion opposing the image baring member 510 while bearing toner T thereon, a supplying roller 523 to replenish toner T in the case 521 to the toner bearing roller 522, a blade 524 to uniform the layer thickness of toner T borne on the toner bearing roller 522, and so on. In addition, the toner bearing roller 522 and the supplying roller 523 are designed to rotate in the directions indicated by the arrow.

Inside the toner supplying device 520, a toner removing roller 540 is disposed with which the tip of a cleaning blade 541 contacts.

A laser beam scanning device 530 is disposed on the back side of the image bearing member 510 where toner T is supplied by toner bearing roller 522. The laser beam scanning device 530 has a laser beam source (not shown), a collimator lens (not shown), a polygon mirror 531, an fθ lens 532, and a reflective mirror 534 having a reed form having the significantly same length as the breadth of the image bearing member 510. In addition, the laser beam scanning device 530 provides heat imagewise to toner T on the toner bearing member 522 via the image bearing member 510 according to image information. In this embodiment, the laser beam scanning device 530 irradiates the image bearing member 510 from its backside. It is also possible to provide the laser beam scanning device 530 outside the image bearing member 510 to directly provide heat on toner T by laser beam instead of via the image bearing member 510.

Figure 5:
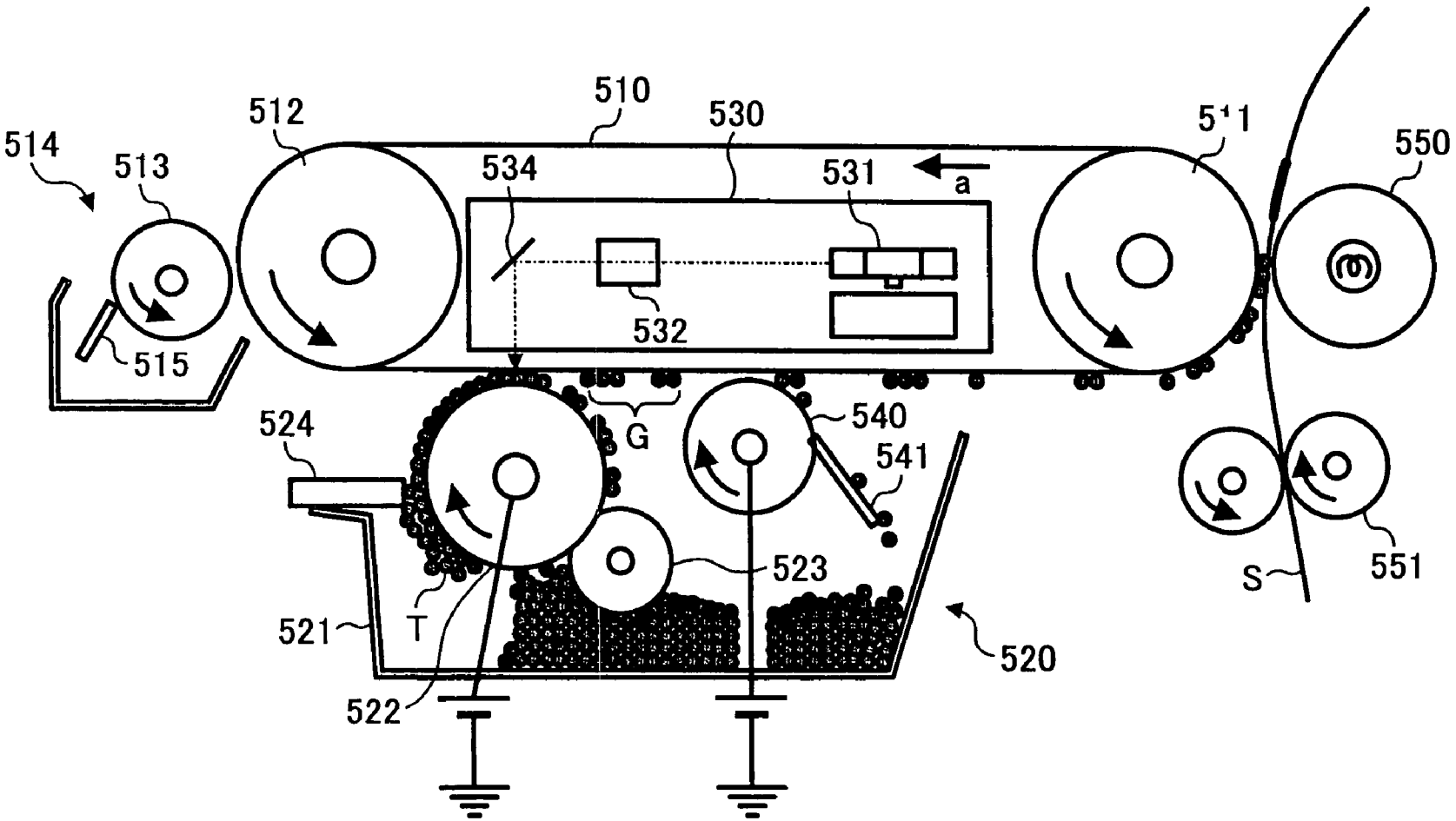
FIG. 5 is a schematic diagram illustrating an example of performing image formation by the image forming method of the present invention with an image forming apparatus taking an adhesive transfer system.

In the toner supplying device 520 of the image forming apparatus 500 illustrated in FIG. 5 adopting an adhesive transfer system, toner T contained in the case 521 is supplied to the toner bearing roller 522 and the blade 524 uniforms the layer thickness of toner T borne on the toner bearing roller 522 to provide a desired amount of toner to the opposing portion between the image bearing member 510 and the toner bearing roller 522. The toner bearing roller 522 and the supplying roller 523 have different speeds at their opposing portions while the toner bearing roller 522 and the supplying roller 523 are in contact with each other. Thereby, toner is abrasively charged (for example, negatively charged). In addition, a positive bias is provided to the toner bearing roller 522 relative to the supplying 523 to impart electrostatic adhesive force to toner T. Toner T having the electrostatic adhesive force is thus supplied to the toner bearing roller 522.

Next, in the laser beam scanning device 530, heat according to image information is conveyed by laser beam to toner T on the toner bearing roller 522 via the image bearing member 510. Toner T becomes adhesive by thermal energy of the laser beam with which toner T is irradiated and is temporarily fixed on the surface of the image bearing member 510 while visualizing the image. In addition, after a visualized image G is temporarily fixed on the image bearing member 510, the toner (remaining toner) existing on the portion (non-image portion) on the image bearing member 510 other than the visualized image G on the image bearing member 510 is removed by being electrostatically attracted to the toner removing roller 540 to which a positive bias is applied. The toner removing roller 540 is provided to remove toner existing on the non-image portion on the image bearing member 510 and causing background fouling other than the rightfully temporarily fixed toner. The attractive force of the toner removing roller 540 is weaker than the temporarily fixing force of toner T on the image bearing member 510. In addition, when the amount of toner attached to the non-image portion mentioned above is few, it is possible to dispense with the toner removing roller 540.

Visualized toner G is transferred to and fixed on a recording medium S by heat fusion by a heating roller 550 on the downstream side from the opposing portion of the image bearing member 510 and the removing roller 540. The recording medium S is fed by a paper feeding device (not shown) and transferred to the heating roller 550 to the visualized image forming area on the image bearing member 510 by a pair of registration rollers 551. The visualized image G is transferred and fixed by heating from its backside. After the visualized image G is transferred and fixed, the image bearing member 510 is cleaned by the cleaning roller 513 and dust including toner on the cleaning roller 513 is scraped by the blade 515.

Since toner having good characteristics on, for example, fluidity and fixability and a good combination of excellent low temperature fixability and heat-resistant preservability is used in the image forming method and the image forming apparatus of the present invention, quality images can be efficiently obtained.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Adhesive Base Material Preparing Process

Toner was prepared as follows:

Preparation of Solution and/or Dispersion Liquid of Toner Component

Synthesis of Non-Modified Polyester (Polyester Having a Low Molecular Weight)

A non-modified polyester was synthesized as follows.

(1) The following components were placed in a reaction container having a condenser, a stirrer and a nitrogen introducing tube and reacted for 8 hours at 230° C. under normal pressure.

| | |
|---|---|
| Adduct of bisphenol A with 2 moles of ethylene oxide | 724 |
| Adduct of bisphenol A with 3 moles of propion oxide | 84 |
| terephthalic acid | 274 |
| Dibutyl tin oxide | 2 |

(2) The reaction was further performed for 5 hours under a reduced pressure of from 10 to 15 mmHg.

The thus obtained non-modified polyester had a number average molecular weight (Mn) of 2,100, a weight average molecular weight (Mw) of 5,600 and a glass transition temperature of 58° C.

Preparation of Master Batch (MB)

One thousand (1,000) parts of water, 540 parts of carbon black (Printex 35, manufactured by Degussa AG, having a dibutyl phthalate (DBP) oil absorption of 42 ml/100 mg and a PH of 9.5), and 1200 parts of the non-modified polyester resin mentioned above were mixed using a HENSCHEL mixer (manufactured by Mitsui Mining Company, Limited). This mixture was kneaded for 30 minutes at 150° C. using a two-roll mill followed by rolling and cooling. Then the kneaded mixture was pulverized. A master batch 1 was thus prepared.

Preparation of Plasticizer Dispersed Liquid

A plasticizer dispersed liquid was prepared by: mixing 200 parts of docosanoic acid (having a melting point of 78° C.) as the plasticizer, 400 parts of polyester resin, and 800 parts of ethyl acetate; and dispersing the plasticizer using a bead mill (ULTRAVISCOMILL, manufactured by Aimex Co., Ltd.) under the following conditions:

Liquid feeding speed: 1 kg/hr,
Disc rotation speed: 6 m/sec,
Diameter of zirconia beads: 0.5 mm,
Filling factor: 80% by volume, and
Repeat number of dispersion treatment: 3 times.

The solubility of the plasticizer in an organic solvent measured at 25° C. was 0 weight %.

Preparation of Prepolymer

An intermediate polyester was synthesized as follows.

(1) The following components were placed in a reaction container having a condenser, a stirrer and a nitrogen introducing tube and reacted for 8 hours at 230° C. under normal pressure.

Adduct of Bisphenol A with 2 Moles of Ethylene Oxide 682

| | |
|---|---|
| Adduct of bisphenol A with 2 moles of propion oxide | 81 |
| terephthalic acid | 283 |
| anhydride of trimellitic acid | 22 |
| Dibutyl tin oxide | 2 |

The reaction was further performed for 5 hours under a reduced pressure of from 10 to 15 mmHg.

The thus obtained intermediate polyester had a number average molecular weight (Mn) of 2,100, a weight average molecular weight (Mw) of 9,600, a glass transition temperature of 55° C., an acid value of 0.5 and a hydroxyl value of 49.

Next, a prepolymer (a polymer of the compound mentioned above having an active hydrogen group and the polymer mentioned above reactive therewith) was synthesized as follows:

| The following components were placed in a reaction container having a condenser, a stirrer and a nitrogen introducing tube and reacted for 5 hours at 100° C. | |
|---|---|
| Intermediate polyester | 411 |
| Isophorone diisocyanate | 89 |
| Ethyl acetate | 500 |

The content of isolated isocyanate in the obtained prepolymer was 1.60 weight % and the solid portion density of the prepolymer measured after left at 150° C. for 45 minutes was 50 weight %.

Preparation of Ketimine (the Compound Mentioned above Having an Active Hydrogen Group)

A ketimine compound (the compound mentioned above having an active hydrogen group) was synthesized as follows:

| The following components were placed in a reacting container having a stirrer and a thermometer and reacted for 5 hours at 50° C. | |
|---|---|
| Isophorone diamine | 30 |
| Methylethyl ketone | 70 |

The thus obtained ketimine compound (the compound mentioned above having an active hydrogen group) had an amine value of 423.

15 parts of the prepolymer mentioned above, 60 parts of the non-modified polyester, 130 parts of ethyl acetate and 100 parts of the plasticizer dispersed liquid were set and dissolved in a beaker while stirring.

Next, solution and/or dispersion liquid of toner component was prepared as follows:

10 parts of carnauba wax (molecular weight of 1,800, acid value of 2.5 and penetration of 1.5 mm at 40° C.), and 10 parts of the master batch mentioned above were added and a material solution was prepared using a bead mill (ULTRAVISCOMILL, manufactured by Aimex Co., Ltd.) under the following conditions:

Liquid feeding speed: 1 kg/hr,
Disc rotation speed: 6 m/sec,
Diameter of zirconia beads: 0.5 mm,
Filling factor: 80% by volume, and
Repeat number of dispersion treatment: 3 times.

Thereafter, 2.7 parts of the ketimine compound was added and dissolved therein to prepare a solution or a dispersion of a toner component.

Preparation of Aqueous Medium Phase

An aqueous medium phase was prepared by mixing and stirring to uniformly dissolve 306 parts of deionized water, 265 parts of 10 weight % suspension of tricalcium phosphate, and 0.2 parts of sodium dodecyl benzene sulfonate.

Preparation of Emulsification and/or Dispersion Liquid 150 parts of the aqueous medium phase mentioned above were set in a container and stirred using a TK HOMOMIXER (manufactured by Tokushu Kika Kogyo Co., Ltd.) at a revolution of 12,000 rpm. 100 parts of the solution and/or dispersion liquid of the toner component mentioned above were added thereto and the resultant was mixed for 10 minutes to prepare an emulsification and/or dispersion liquid (emulsified slurry).

Removal of Organic Solvent 100 parts of the emulsified slurry was set in a flask having a stirrer and a temperature and the solvent was stirred at a stirring speed of 20 m/min at 30° C. for 12 hours and removed.

Washing and Drying

After filtrating 100 parts of the emulsified slurry under a reduced pressure, 100 parts of deionized water was added to the filtration cake. The resultant was mixed with a TK HOMOMIXER with a rotation of 12,000 rpm for 10 minutes and then filtrated. 300 parts of deinonization water was added to the obtained filtration cake. The resultant was mixed with a TK HOMOMIXER with a rotation of 12,000 rpm for 10 minutes and then filtrated. 300 parts of deinonized water was added and filtrated. Again, the resultant was mixed with a TK HOMOMIXER with a rotation of 12,000 rpm for 10 minutes and then filtrated. 300 parts of deinonized water was added and filtrated. Furthermore, 20 parts of 10 weight % of sodium hydrate solution was added to the obtained filtration cake. The resultant was mixed with a TK HOMOMIXER with a rotation of 12,000 rpm for 30 minutes and then filtrated with a reduced pressure. 300 parts of deinonized water was added to the obtained filtration cake. The resultant was mixed with a TK HOMOMIXER with a rotation of 12,000 rpm for 10 minutes and then filtrated. 300 parts of deinonized water was added to the obtained filtration cake. The resultant was mixed with a TK HOMOMIXER with a rotation of 12,000 rpm for 10 minutes and then filtrated. Again, 300 parts of deinonized water was added, mixed with a TK HOMOMIXER and filtrated. Further, 20 parts of 10 weight % of hydrochloric acid was added to the filtration cake. The resultant was mixed with a TK HOMOMIXER with a rotation of 12,000 rpm for 10 minutes and then filtrated. 300 parts of deinonized water was added to the obtained filtration cake. The resultant was mixed with a TK HOMOMIXER with a rotation of 12,000 rpm for 10 minutes and then filtrated. Again, 300 parts of deinonized water was added, mixed with a TK HOMOMIXER, and filtrated again. The final filtration cake was thus obtained. The obtained final filtration cake was dried at 45° for 48 hours by an air circulating dryer and sieved having a mesh of 45 μm to obtain mother toner particles of Example 1.

Example 2

Toner mother particles of Example 2 were prepared in the same manner as described in Example 1 except that the addition amount of plasticizer dispersed liquid was changed from 100 parts to 200 parts in the process of preparing the solution and/or the dispersion liquid of the toner component.

Example 3

Toner mother particles of Example 3 were prepared in the same manner as described in Example 2 except that 5 parts of 3-5-di-tert butyl salicylic acid Fe (III) complex was added in the process of preparing the solution and/or the dispersion liquid of the toner component.

Example 4

Toner mother particles of Example 4 were prepared in the same manner as described in Example 1 except that docosaconic acid used in the preparation of plasticized dispersed liquid was replaced with n-octadecyl alcohol having a melting point of 57° C.

In addition, the solubility of the plasticizer to the organic solvent measured at 25° C. was 1 weight %.

Example 5

Toner mother particles of Example 5 were prepared in the same manner as described in Example 1 except that the plasticizer dispersed liquid used in the process of preparing the solution and/or the dispersion liquid of the toner component was changed to 40 parts of dibenzyl oxalate (having a melting point of 102° C. showing solubility to ethyl acetate) and 500 parts of ethanol functioning as a poor solvent thereto was further added.

In addition, the solubility of the plasticizer in the organic solvent measured at 25° C. was 5 weight %.

Example 6

Toner was prepared by a suspension polymerization method as follows:

Preparation of Solution and/or Dispersion Liquid of Toner Component (Monomer Composition)

The following materials were stirred and mixed at room temperature using a stirrer and uniformly dispersed by a media type dispersing device to obtain a monomer composition.

| | |
|---|---|
| Polymeric monomer formed of 80.5 parts of styrene and 19.5 parts of n-butylacrylate | 100 |
| Carbon black (Printex 35, manufactured by Degussa AG, having a dibutyl phthalate (DBP) oil absorption of 42 ml/100 mg and a PH of 9.5 | 6 |
| Charge control agent (Spiron black TRH, manufactured by Hodogaya Chemical Co., Ltd) | 1 |
| Divinyl benzene | 0.4 |
| t-dodecyl mercaptan | 1.0 |
| Carnauba wax | 10 |
| Macromonomer of polymethacrylate | 0.5 |

Plasticizer Dispersed Liquid Prepared by Using n-Stearyl Stearylic Cid Amide (Having a Melting Point of 95° C.) Instead of Docosaconic Acid 50

Preparation of Aqueous Medium Phase

Magnesium hydrate colloid (metal hydrate colloid hardly soluble in water) was prepared by: gradually dropping an aqueous solution in which 5.8 parts of sodium hydrate (alkali metal hydrate) was dissolved in 50 parts of deionized water to an aqueous solution in which 9.5 parts of magnesium chloride (water-soluble multivalent metal salt) dissolved in 250 parts of deionized water at room temperature while stirring.

Granulation

The monomer composition mentioned above was set in the obtained magnesium hydrate colloid dispersion liquid at room temperature and dispersed by stirring until the liquid droplets were stable. Thereafter, 5 parts of t-butylperoxy-2-ethylhexanoate were added thereto as an oil-soluble polymerization initializer. Further, the resultant was subject to stirring with high shearing force using a TK HOMOMIXER with a rotation of 15,000 rpm for 10 minutes to obtain fine liquid droplets formed of monomer composition.

Polymerization

Aqueous dispersion medium (suspension liquid) of the granulated monomer composition was set in a reaction container having a stirring blade and heated to 90° C. to start polymerization reaction. After performing polymerization reaction for 10 hours, the compound was cooled with water to complete the polymerization reaction. Next, the resultant was subject to filtration, washing and drying in the same manner as in Example 1 to prepare toner mother particles of Example 6.

Comparative Example 1

Toner was prepared by a pulverization method as follows:

| The following compounds were sufficiently stirred and mixed by a HENSHCEL mixer: | |
|---|---|
| Non-modified polyester obtained in Example 1 | 100 |
| Carnauba wax | 4.5 |
| Carbon black (Printex 35 Printex 35, manufactured by Degussa AG, having a dibutyl phthalate (DBP) oil absorption of 42 ml/100 mg and a PH of 9.5) | 8 |
| Docosaconic acid | 10 |

The resultant was heated and fused at 130° C. for 30 minutes using a roll mill. Subsequent to cooling down to room temperature, the obtained kneaded mixture was coarsely pulverized by a hammer mill to particles having a diameter of from 200 to 400 μm. The resultant was subject to pulverization and classification using IDS-2 type pulverization and classification device (manufactured by Nippon pneumatic MFG. Co., Ltd.) which has a fine pulverization device and an air classification device. The fine pulverization device finely pulverizes coarse pulverized powder by colliding the coarse pulverized powder to a collision board. The air classification device forms a swirling flow of the finely pulverized powder obtained in the fine pulverization device to classify the pulverized powder by centrifugal separation. Toner mother particles complete with classification were thus obtained.

Particle size distribution can be measured by a Coulter counter, and desirably adjusted by controlling the supplying amount of pulverized material, pressure and flow ratio of pressurized air for pulverization, the form of collision board for pulverization, air flowing position and direction when it is sucked in a classification device, a discharging blower pressure, and so on.

Comparative Example 2

Toner of Comparative Example 2 was manufactured in the same manner as in Comparative Example 1 except that the addition amount of docosaconic acid was changed from 10 to 20 parts.

Comparative Example 3

Toner of Comparative Example 3 was manufactured in the same manner as in Example 1 except that docosaconic acid in the process of preparing the plasticizer dispersed liquid was replaced with a benzotriazol derivative (EVERSORB 75, manufactured by Dainippon Ink and Chemicals, Incorporated, having melting point of 152° C.), which does not impart a plasticizing effect to toner resin.

Comparative Example 4

Toner of Comparative Example 4 was manufactured in the same manner as in Example 6 except that the plasticizer dispersed liquid in the process of preparing the monomer component was replaced with 10 parts of dibehenyl phthalate having a melting point of 57° C.

In addition, the solubility of the plasticizer in the organic solvent measured at 25° C. was 0 weight %.

Comparative Example 5

Toner mother particles of Comparative Example 5 were prepared in the same manner as described in Example 1 except that the plasticizer dispersed liquid used in the process of preparing the solution and/or the dispersion liquid of the toner component was changed to 40 parts of dibenzyl oxalate.

In addition, the solubility of the plasticizer in the organic solvent measured at 25° C. was 10 weight %.

Comparative Example 6

Toner mother particles of Comparative Example 6 were prepared in the same manner as described in Example 1 except that docosaconic acid used in the process of preparing the plasticizer dispersed liquid was replaced with n-butylstearylic acid having a melting point of 24° C.

External Additive Treatment 100 parts of each of the toner mother particles obtained from Examples 1 to 6 and Comparative Examples 1 to 6 were mixed with 1.0 part of hydrophobic silica (H2000, manufactured by Clariant Japan, KK) as an external additive by a HENSCHEL mixer (manufactured by Mitsui Mining Co., Ltd.) with a peripheral speed of 30 m/s for 30 seconds with an interval of one minute 5 times. The mesh had a 35 μm opening. Toner of Examples 1 to 6 and Comparative Examples 1 to 6 were thus obtained.

A carrier was prepared as follows.

| The following materials were added to 100 parts of toluene: | |
|---|---|
| Silicone resin (Organo straight silicone) | 100 |
| r-(2-aminoethyl)aminopropyl trimethoxy silane | 5 |
| Carbon black | 10 |

The mixture was dispersed with a HOMOMIXER for 20 minutes to prepare a coating layer forming liquid. The coating layer forming liquid was coated with a fluid bed type coating device on the surface of 1,000 parts of spherical magnetite having a particle diameter of 50 μm to obtain a magnetic carrier.

Thermal characteristics, i.e., (Tg2r−Tg2t), [(Tg2r−Tg1r)−(Tg2t−Tg1t)], and (Tg1r−Tg1t) for each toner of Examples 1 to 6 and Comparative Examples 1 to 6 were measured. The results are shown in Table 1.

The thermal characteristics mentioned above were measured by a differential scanning calorimeter (DSC) system (DSC-60, manufactured by Shimadzu Corporation) as follows.

In the case of the glass transition temperature (Tg1r and Tg1t) of a resin and toner for the first time temperature rising; Set about 5.0 mg of a sample resin or toner in a sample container made of aluminum; Place the sample container on a holder unit; Set the sample container in an electric furnace; Heat the sample from 20° C. to 150° C. at a rate of 10° C./min in nitrogen atmosphere; Measure DSC curve by a differential scanning calorimeter (DSC) system (DSC-60, manufactured by Shimadzu Corporation); and Calculate the glass transition temperature of the resin (or toner) from the intersection point of the tangent of the curve before the flexion point of the resin or the toner and the tangent of the curve after the flexion point thereof using the analysis program installed in the DSC-60 system. In addition, from the peak value deriving from the plasticizer, the melting point (Tm) of the plasticizer was obtained.

In the case of the glass transition temperature (Tg2r and Tg2t) of a resin and toner for the second time temperature rising; Subsequent to the first temperature rising, cool down the sample from 150° C. to 0° C. at a rate of −10° C./min; Heat the sample to 150° C. at a rate of 10° C./min in nitrogen atmosphere; Measure DSC curve by a differential scanning calorimeter (DSC) system (DSC-60, manufactured by Shimadzu Corporation); and Calculate the glass transition temperature of the resin (or toner) from the intersection point of the tangent of the curve before the flexion point of the resin or the toner and the tangent of the curve after the flexion point thereof using the analysis program installed in the DSC-60 system.

Each two-component developer of Examples 1 to 6 and Comparative Examples 1 to 6 was prepared by mixing with a ball mill 5 parts of each of external additive added toners of Examples 1 to 6 and Comparative Examples 1 to 6, respectively.

Each obtained developer was evaluated on (a) fixability (offset occurring temperature and lowest allowable fixing temperature), (b) heat-resistant preservability, (c) fluidity, and (d) copy blocking as follows. The results are shown in Tables 1 and 2.

(a) Fixability (Offset Occurring Temperature and Lowest Allowable Fixing Temperature)

Fixability (offset occurring temperature and lowest allowable fixing temperature) was evaluated using an apparatus remodeled based on a tandem type color electrophotographic apparatus (Imagio Neo C350, manufactured by Ricoh, Co. Ltd.) and plain paper (TYPE 6000 <70W>Y mesh, manufactured by Ricoh, Co. Ltd.). The apparatus was modified in such a manner that the silicone oil application mechanism in the fixing unit was removed and an oil-less fixing was adopted to control temperature and linear speed.

The tandem type color electrophotographic apparatus mentioned above can consecutively print 35 A4 size paper per minute. Fixability was evaluated while changing the temperature of the fixing roller with a linear speed of 125 mm/s.

Offset Occurring Temperature

Image formation was adjusted such that solid color images of each color of yellow, magenta, cyan and black were developed on the plain paper mentioned above with the amount of toner of from 0.82 to 0.88 mg/cm$^2$ using the tandem type electrophotographic apparatus mentioned above. The thus obtained images were fixed varying the temperature of the heating roller. The fixing temperature (offset occurring temperature) at which hot offset occurred was measured and evaluated according to the following criteria.

Evaluation Criteria

E (Excellent): 210° C. or higher

G (Good): 190 to lower than 210° C.

F (Fair): 170 to lower than 190° C.

P (Poor): lower than 170° C.

Allowable Lowest Fixing Temperature

Photocopying test was performed using the tandem type electrophotographic apparatus mentioned above and the plain paper mentioned above. The allowable lowest fixing temperature is a temperature at a fixing roll below which the remaining ratio of the density of a fixed image is less than 70% after abrading the fixed image with a pad. The images were evaluated according to the following criteria.

Evaluation Criteria

E (Excellent): less than 100° C.

G (Good): 100 to less than 120° C.

F (Fair): 120 to less than 140° C.

P (Poor): 140° C. or higher.

(b) Heat-Resistant Preservability (Penetration)

Each toner was filled in a glass container having a volume of 50 ml and left in a constant temperature bath at 50° C. for 24 hours. Subsequent to cooling down, penetration (mm) was measured by the penetration test (JIS K2235-1991) and evaluated according to the following criteria. The greater the value of the penetration is, the more excellent the heat-resistance preservability is. When the penetration value is too small, a practical usage problem tends to occur.

Evaluation Criteria

G (Good): 25 mm or greater

F (Fair): 15 mm to not greater than 25 mm

P (Poor): less than 15 mm.

(c) Fluidity

A powder tester (manufactured by Hosokawa Micron Corporation) was used as a measuring device. The following accessories were placed on the vibration table in the following order: (A) bibroshute, (B) packing, (C) space ring, (D) sieve (three kinds: top, middle and bottom), and holding bar. These accessories were fixed with knob nuts and the vibration table was operated. Fluidity was measured according to the following conditions:

Measuring Conditions

Sieve mesh (top): 75 μm

Sieve mesh (middle): 45 μm

Sieve mesh (bottom): 22 μm

Amplitude scale: 1 mm

Amount of sample taken: 10 g

Vibration time: 30 seconds.

After the measurement under the conditions mentioned above, agglomeration degree (%) of the toner was calculated based on the following relationships (3) to (6). Fluidity of the toner was evaluated according to the following criteria.

$A$ (%)=the weight of the powder remaining on the top sieve/the amount of sample taken)×100 Relationship (3)

$B$ (%)=the weight of the powder remaining on the middle sieve/the amount of sample taken)×100 Relationship (4)

$C$ (%)=the weight of the powder remaining on the bottom sieve/the amount of sample taken)×100 Relationship (5)

Agglomeration degree (%)=$A+B+C$ Relationship (6)

Evaluation Criteria

E (Excellent): less than 5%

G (Good): less than 10%

F (Fair): less than 20%

P (Poor): 20% or higher.

(d) Copy Blocking

A standard image having an image area of 7% were consecutively output 1,000 times. The adhesive state between papers are observed with a naked eye and evaluated according to the following criteria.

Evaluation Criteria

E (Excellent): Sheets are separated without a problem

G (Good): Some sheets stacked on the bottom should be separated

F (Fair): Separated but necessary to move stacked paper upward and downward of the paper direction P (Poor): still partially adhered even after moving stacked sheets upward and downward of the paper direction.

TABLE 1

| | Plasticizer | | | | | |
|---|---|---|---|---|---|---|
| | Density (weight %) | Solubility (weight %) | Tm (° C.) | Tg2r − Tg2t | (Tg2r − Tg1r) − (Tg2t − Tg1t) | Tg1r − Tg1t |
| Example 1 | 10 | 0 | 78 | 10 | 10 | 0 |
| Example 2 | 20 | 0 | 78 | 20 | 20 | 0 |
| Example 3 | 20 | 0 | 78 | 20 | 20 | 0 |
| Example 4 | 10 | 1 | 57 | 10 | 5 | 5 |
| Example 5 | 10 | 5 | 102 | 15 | 10 | 5 |
| Example 6 | 20 | 0 | 96 | 20 | 10 | 10 |
| Comparative Example 1 | 10 | 0 | 78 | 10 | 0 | 10 |
| Comparative Example 2 | 10 | 0 | 78 | 20 | 0 | 20 |
| Comparative Example 3 | 10 | 0 | 152 | 20 | 0 | 0 |
| Comparative Example 4 | 10 | 0 | 57 | 20 | 0 | 15 |
| Comparative Example 5 | 10 | 10 | 102 | 20 | 0 | 15 |
| Comparative Example 6 | 10 | 0 | 24 | 20 | 0 | 15 |

TABLE 2

| | | | Fixability | | | | |
|---|---|---|---|---|---|---|---|
| | Manufacturing Method | Cross linkage | Anti-hot offset property | Low fixing temperature | Heat-resistant preservability | Fluidity | Copy blocking |
| Example 1 | P × P | No | E | G | E | E | E |
| Example 2 | P × P | No | G | E | G | G | G |
| Example 3 | P × P | Yes | E | E | E | E | E |
| Example 4 | P × P | No | E | G | G | G | G |
| Example 5 | P × P poor solvent | No | G | G | G | G | E |
| Example 6 | Suspension polymerization | No | E | G | E | E | E |
| Comparative Example 1 | Pulverization method | No | G | G | F | F | G |
| Comparative Example 2 | Pulverization method | No | F | E | P | P | F |
| Comparative Example 3 | P × P | No | E | P | E | E | E |
| Comparative Example 4 | Suspension polymerization | No | E | P | E | E | E |
| Comparative Example 5 | P × P | No | F | E | P | P | F |
| Comparative Example 6 | P × P | No | E | G | F | F | G |

P×P in the toner preparation method in Table 2 represents the following ester elongation polymerization method: Prepare a solution or a dispersion liquid by emulsifying and/or dispersing a toner component having a compound having an active hydrogen group and a polymer reactive therewith; Prepare an emulsification and/or dispersion liquid by emulsifying and/or dispersing the solution or the dispersion liquid of the toner component in an aqueous medium; and Granulate toner particles by reacting the compound having an active hydrogen group and the polymer reactive therewith to obtain particles containing an adhesive material while forming the adhesive base material.

As seen in the results shown in Tables 1 and 2, the following is obvious. That is, in Example 1, the toner having an excellent fluidity, heat-resistant preservability, and fixability free from copy blocking is obtained. The toner obtained in Example 2 has excellent lowest allowable fixing temperature since the content of the plasticizer is relatively high in comparison with that in Example 1. The toner obtained in Example 3 has excellent in heat-resistant preservability, fluidity, and anti-hot offset property since a cross linkage agent is added thereto. The toner obtained in Example 4 is slightly inferior in heat-resistant preservability and fluidity to these in Example 1 since the plasticizer is dissolved in an amount of 1 weight %. The toner obtained in Example 5 is inferior in heat-resistant preservability and fluidity since part of the plasticizer is dissolved while precipitating in the toner due to the poor solvent. The toner obtained in Example 6 does not have significantly high heat-resistant preservability and fluidity since the plasticizer has a low melting point.

Example 7

Mother toner particles of Example. 7 were manufactured in the same manner as in Example 1 except that 200 parts of polyglycerine ester of stearic acid having a weight average molecular weight (Mw) of 942 and a melting point of 86° C. were used instead of the docosanoic acid and 100 parts of polyethylene modified organopolysiloxane having a melting point of 72° C. were used as wax instead of the carnauba wax.

In Example 7, the wax and the plasticizer were found to be non-compatible according to the DSC measuring method described above and XRD measuring method described later.

Example 8

Mother toner particles of Example 8 were manufactured in the same manner as in Example 7 except that polyethylene modified organopolysiloxane having a melting point of 72° C. was used instead of polyethylene modified organopolysiloxane having a melting point of 60° C.

In Example 8, the wax and the plasticizer were found to be non-compatible according to the DSC measuring method described above and XRD measuring method described later. Further, the difference in the melting points of the wax and the plasticizer was relatively large in comparison with that in Example 8, anti-cold offset property was further improved.

Example 9

Mother toner particles of Example 9 were manufactured in the same manner as in Example 7 except that polyglycerine ester of stearic acid was substituted by 40 parts of dibenzyl ester of oxalic acid, 500 parts of ethanol functioning as poor solvent to dibenzyl ester of oxalic acid were added, and paraffin wax having a melting point of 68° C. was used as wax instead of polyethylene modified organopolysiloxane.

In Example 9, the plasticizer was precipitated by putting the poor solvent. The wax and the plasticizer were found to be non-compatible according to the DSC measuring method described above and XRD measuring method described later.

Example 10

Mother toner particles of Example 10 were manufactured in the same manner as in Example 7 except that polyglycerine ester of stearic acid was replaced with 40 parts of behenyl alcohol having a melting point of 80° C.

In Example 10, the plasticizer and the resin were found to be partially dissolved in each other and the wax and the plasticizer were found to be non-compatible according to the DSC measuring method described above and XRD measuring method described later.

Example 11

Mother toner particles of Example 11 were manufactured by a suspension polymerization method and in the same manner as in Example 6 except that polyethylene modified organopolysiloxane having a melting point of 72° C. were used as wax instead of the carnauba wax.

In Example 11, the wax and the plasticizer were found to be non-compatible according to the DSC measuring method described above and XRD measuring method described later.

Comparative Example 7

Mother toner particles of Comparative Example 7 were manufactured in the same manner as in Example 7 except that paraffin wax having a melting point of 68° C. as wax.

In Comparative Example 7, the wax and the plasticizer were found to be dissoloved in each other according to the DSC measuring method described above and XRD measuring method described later.

Comparative Example 8

Mother toner particles of Comparative Example 8 were manufactured in the same manner as in Example 7 except that polyglycerine ester of stearic acid was changed to p-hydroxy dibenzyl ester of benzoic acid having a melting point of 110° C. and carnauba wax having a melting point of 88° C. was used as wax.

In Comparative Example 8, the wax and the plasticizer were found to be dissolved in each other according to the DSC measuring method described above and XRD measuring method described later. However, the plasticizer and the resin were dissolved in each other. Therefore, the preservability of the toner deteriorated.

Comprative Example 9

Mother toner particles of Comprative Example 9 were manufactured in the same manner as in Comparative Example 1 except that polyethylene modified organopolysiloxane having a melting point of 72° C. was used as wax instead of carnauba wax, and polyglycerine ester of stearic acid having a weight average molecular weight (Mw) of 942 and a melting point of 86° C. was used instead of docosanoic acid.

In Comprative Example 9, the wax and the plasticizer were found to be non-compatible according to the DSC measuring method described above and XRD measuring method described later. Therefore, the anti-cold offset property is excellent (refer to Table 3). In addition, since the toner was manufactured by a pulverization method, the plasticizer and the resin were dissolved in each other. Therefore, the heat-resistant property of the toner deteriorates.

Comparative Example 10

Mother toner particles of Comprative Example 10 were manufactured in the same manner as in Example 7 except that polyglycerine ester of stearic acid was changed to stearic acid having a melting point of 68° C. and paraffin wax was used as wax.

In Comprative Example 10, the wax and the plasticizer were found to be dissolved in each other according to the DSC measuring method described above and XRD measuring method described later. Therefore, the anti-cold offset property deteriorates (refer to Table 3). In addition, since the toner was manufactured by a pulverization method, the plasticizer and the resin were dissolved in each other. Therefore, the heat-resistant property of the toner deteriorates.

External Additive Treatment 100 parts of each of the toner mother particles obtained from Examples 7 to 11 and Comparative Examples 7 to 10 were mixed with 1.0 part of hydrophobic silica (H2000, manufactured by Clariant Japan, KK) as an external additive by a HENSCHEL mixer (manufactured by Mitsui Mining Co., Ltd.) with a peripheral speed of 30 m/s for 30 seconds with an interval of one minute 5 times. The mesh had a 35 μm opening. Toner of Examples 7 to 11 and Comparative Examples 7 to 10 were thus obtained.

Thermal characteristics, i.e., (Tg2r−Tg2t), [(Tg2r−Tg1r)−(Tg2t−Tg1t)], and (Tg1r−Tg1t) for each toner of Examples 7 to 11 and Comparative Examples 7 to 10 were measured by the DSC measuring method described above. The results are shown in Table 3.

Confirmation of Changes of State of Plasticizer in Toner before and after Heating by XRD Method When a plasticizer is crystal, whether or not the plasticizer is dissolved in a resin before and after heating can be confirmed by crystal analysys X ray diffraction device (X'Pert MRDX'Pert MRD, manufactured by Royal Philips Electronics).

The XRD method is as follows: grind a plasticizer in a mortar to obtain a sample powder; uniformly apply the obtained sample powder to the sample holder; thereafter, set the sample holder in the diffraction device; measure the diffraction specrum of the plasticizer; apply toner powder to the holder; and perform measument. It is possible to determine the plasticizer contained in the toner based on the diffraction spectrum of the plasticizer beforehand. In addition, it is also possible to measure changes of the diffraction spectrum when the temperature is changed by an accessory-heating unit. The ratio of the dissolved and non-dissolvd portions of the plasticizer in a resin before and after heating can be obtained based on the changes in the peak area of the X ray diffraction spectrum deriving from the plasticizer at room temperature and 150° C. using the heating unit.

TABLE 3

| | Tg2r − Tg2t | (Tg2r − Tg1r) − (Tg2t − T1t) | Tp (melting point of plasticizer) | Tw (melting point of wax) | Tp − Tp' (shift of plasticizer fusion peak after heating) | Tw − Tw' (shift of wax fusion peak after heating) | Solubility of plasticizer (weight %) |
|---|---|---|---|---|---|---|---|
| Example 7 | 15 | 15 | 86 | 78 | <1 | <1 | 0 |
| Example 8 | 15 | 15 | 86 | 60 | <1 | <1 | 0 |
| Example 9 | 15 | 15 | 102 | 68 | <1 | <1 | 5 |
| Example 10 | 20 | 10 | 80 | 78 | <1 | <1 | 1 |
| Example 11 | 10 | 10 | 95 | 78 | <1 | <1 | 0 |
| Comparative Example 7 | 15 | 15 | 86 | 68 | 3 | 3 | 0 |
| Comparative Example 8 | 15 | 0 | 110 | 88 | <1 | <1 | 10 |
| Comparative Example 9 | 15 | 0 | 72 | 86 | <1 | <1 | 0 |
| Comparative Example 10 | 15 | 0 | 72 | 86 | 3 | 3 | 10 |

Two-component developers of Examples 7 to 11 and Comparative Examples 7 to 10 were manufactured using the carrier manufactured above in the same manner as mentioned above. Each obtained developer was evaluated on allowablve lowest fixing temperature, heat-resistant preservability, anti-hot offset property, and anti-cold offset property as follows. The results are shown in Table 4.

Allowablve Lowest Fixing Temperature

Allowable lowest fixing temperature was evaluated using an apparatus remodeled based on a tandem type color electrophotographic apparatus (Imagio Neo C350, manufactured by Ricoh, Co. Ltd.) and plain paper (TYPE 6000 <70W> Y mesh, manufactured by Ricoh, Co. Ltd.). The apparatus was modified in such a manner that the silicone oil application mechanism in the fixing unit was removed and an oil-less fixing was adopted to control temperature and linear speed.

The tandem type color electrophotographic apparatus mentioned above can consecutively print 35 A4 size paper per minute. Allowable lowest fixing temperature was evaluated while changing the temperature of the fixing roller with a linear speed of 125 mm/s.

The allowable lowest fixing temperature is a temperature at a fixing roll below which the remaining ratio of the density of a fixed image is less than 70% after abrading the fixed image with a pad. The images were evaluated according to the following criteria.

E (Excellent): less than 100

G (Good): 100 to less than 120

F (Fair): 120 to less than 140

P (Poor): 140 or higher.

Offset Occurring Temperature

An apparatus remodeled based on a tandem type color electrophotographic apparatus (Imagio Neo C350, manufactured by Ricoh, Co. Ltd.) was used. The apparatus was modified in such a manner that the silicone oil application mechanism in the fixing unit was removed and an oil-less fixing was adopted to control temperature and linear speed. Image formation was adjusted such that solid color images of each color of yellow, magenta, cyan and black were developed on the plain paper mentioned above with the amount of toner of from 0.82 to 0.88 mg/cm$^2$ using the tandem type electrophotographic apparatus mentioned above. The thus obtained images were fixed varying the temperature of the heating roller. The fixing temperature (offset occurring temperature) at which hot offset occurred was measured and evaluated according to the following criteria.

Evaluation Criteria

E (Excellent): 210° C. or higher

G (Good): 190 to lower than 210° C.

F (Fair): 170 to lower than 190° C.

P (Poor): lower than 170° C.

Cold Offset

Cold offset to a fixed image was observed with a naked eye using the tandem type color electrophotographic apparatus (Imagio Neo C350, manufactured by Ricoh, Co. Ltd.) mentioned above. The cold offset occurring temperature is the temperature when cold offset occurs at a fixing roll. The following criteria are used.

Evaluation Criteria

E (Excellent): less than 100° C.

G (Good): 100 to less than 120° C.

F (Fair): 120 to less than 140° C.

P (Poor): 140° C. or higher.

Heat-Resistant Preservability (Penetration)

Each toner was filled in a glass container having a volume of 50 ml and left in a constant temperature bath at 50° C. for 24 hours. Subsequent to cooling down, penetration (mm) was measured by the penetration test (JIS K2235-1991) and evaluated according to the following criteria. The greater the value of the penetration is, the more excellent the heat-resistance preservability is. When the penetration value is too small, a practical usage problem tends to occur.

Evaluation Criteria

G (Good): 25 mm or greater

F (Fair): 15 mm to not greater than 25 mm

TABLE 4

| | Manufacturing Method | Allowable lowest fixing temperature | Anti-cold offset property | Preservability | Anti-hot offset property |
|---|---|---|---|---|---|
| Example 7 | P × P | E | G | E | G |
| Example 8 | P × P | E | E | E | G |
| Example 9 | P × P poor solvent | G | E | G | G |
| Example 10 | P × P | E | G | G | G |
| Example 11 | Suspension polymerization | G | E | E | G |
| Comparative Example 7 | P × P | G | F | E | P |
| Comparative Example 8 | P × P | E | E | P | G |
| Comparative Example 9 | Kneading and mixing | F | G | P | G |
| Comparative Example 10 | P × P | G | F | P | P |

P × P in the toner preparation method in Table 4 is the same as in the description for Table 2.

This document claims priority and contains subject matter related to Japanese Patent Applications Nos. 2005018870 and 2005-154364, filed on Jan. 26, 2005, and May 26, 2005, respectively, the entire contents of which are incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A toner comprising:

a toner composition comprising:

a resin; and a plasticizer, wherein the plasticizer is present in an amount of from 3 to 20 wt % of the toner;

wherein the toner is prepared by a process comprising:

preparing an emulsification or dispersion liquid by emulsifying or dispersing a solution or dispersion liquid of the toner composition in an aqueous medium; and granulating the toner;

such that the following relationships (1) and (2) are satisfied:

$$Tg2r > Tg2t \quad (1)$$

$$Tg1t - Tg2t > Tg1r - Tg2r \quad (2),$$

and wherein the following relationship is also satisfied:

$$Tg1r - Tg1t < 5(° C.);$$

wherein Tg1r represents a peak of the resin for a first temperature rise and Tg2r represents a peak of the resin for a second temperature rise when a differential scanning calorimeter (DSC) measurement is performed for the resin, Tg1t represents a peak of the toner comprising the resin for the first temperature rise and Tg2t represents a peak of the toner comprising the resin for the second temperature rise when a differential scanning calorimeter (DSC) measurement is performed for the toner.

2. The toner according to claim 1, satisfying the following relationship:

$$Tg2r - Tg2t > 10° C.$$

3. The toner according to claim 1, wherein a melting point (Tm) of the plasticizer satisfies the following relationship:

$$30° C. \leqq Tm < 120° C.$$

4. The toner according to claim 1, wherein a melting point (Tm) of the plasticizer satisfies the following relationship:

$$50° C. \leqq Tm < 120° C.$$

5. The toner according to claim 3, further satisfying the following relationships:

$$Tg1r > Tm,$$

$$60° C. \leqq Tg1r < 100° C.$$

6. The toner according to claim 1, wherein the resin comprises an acid group and at least one of a metal salt or a metal complex which can form a cross-linkage reaction with the acid group.

7. The toner according to claim 1, further comprising a tri- or higher valent cross-linkage agent.

8. The toner according to claim 7, wherein the tri- or higher valent cross-linkage agent is a metal compound of tri- or higher valent salicylic acid.

9. The toner according to claim 7, wherein the tri- or higher valent cross-linkage agent is present in the toner in an amount of 0.05 to 10 weight %.

10. The toner according to claim 1, wherein the resin has a hydroxyl value of not less than 20 mgKOH/g.

11. The toner according to claim 1, wherein the toner composition further comprises an active hydrogen group and a polymer reactive therewith.

12. The toner according to claim 3, wherein the plasticizer is present in the toner in a dispersed state and has a dispersion diameter of from 10 nm to 3 μm.

13. The toner according to claim 12, wherein a solubility of the plasticizer in an organic solvent is not greater than 1 weight % at a temperature of not higher than 25° C.

14. The toner according to claim 12, wherein a solubility of the plasticizer in an organic solvent is not less than 5 weight % at a temperature of not lower than 60° C.

15. The toner according to claim 1, further comprising a wax existing in the resin in a non-compatible state with the resin and the plasticizer.

16. The toner according to claim 15, wherein the plasticizer is compatible with the resin at a temperature of not lower than a glass transition temperature of the plasticizer or of the resin.

17. The toner according to claim 15, wherein the plasticizer has a weight average molucular weight of not greater than 2,000.

18. The toner according to claim 15, satisfying the following relationships (3) and (4):

$$|Tp-Tp'|<1(^\circ\text{ C.}) \quad (3)$$

$$|Tw-Tw'|<1(^\circ\text{ C.}) \quad (4)$$

wherein Tp represents a melting peak of the plasticizer and Tw represents a melting peak of the resin when DSC measurement is performed for the plasticizer and the wax, and Tp' represents a melting peak from the plasticizer contained in a mixture of the plasticizer and the wax in a mixed ratio of 1 to 1 for a second temperature rise when DSC measurement is performed for the mixture and Tw' represents a melting peak from the wax contained in the mixture for a second temperature rise when DSC measurement is performed for the mixture.

19. The toner according to claim 18, satisfying the following relationship:

$$|Tp-Tw|>10(^\circ\text{ C.}).$$

20. The toner according to claim 18, wherein the melting point (Tp) of the plasticizer satisfies the following relationship:

$$50(^\circ\text{ C.})<Tp<120(^\circ\text{ C.}).$$

21. The toner according to claim 18, wherein the melting point (Tw) of the wax satisfies the following relationship:

$$50(^\circ\text{ C.})<Tw<120(^\circ\text{ C.}).$$

22. The toner according to claim 15, wherein a content of the wax is from 3 to 20 weight %.

23. The toner according to claim 18, satisfying the following relationship:

$$Tg2r-Tg2t>10(^\circ\text{ C.}).$$

24. The toner according to claim 18, satisfying the following relationship:

$$Tg1r-Tg1t<5(^\circ\text{ C.}).$$

25. The toner according to claim 18, satisfying the following relationship:

$$Tg1r>Tp, \text{ and}$$

$$100^\circ\text{ C.}>Tg1r\leqq 60^\circ\text{ C.}$$

26. A method of manufacturing a toner, comprising:

preparing an emulsification or dispersion liquid by emulsifying or dispersing a solution or dispersion liquid of a toner component in an aqueous medium; and granulating the toner of claim 1.

27. The method of manufacturing a toner according to claim 26, wherein granulating further comprises reacting a compound having an active hydrogen group and a polymer reactive therewith to form an adhesive base material and to obtain particles comprising an adhesive base material.

28. The method of manufacturing a toner according to claim 26, further comprising dissolving or dispersing the toner composition in an organic solvent to prepare the emulsification or dispersion liquid of the toner composition.

29. The method of manufacturing a toner according to claim 26, wherein the toner is manufactured in a temperature range of from 10 to 100° C.

30. The method of manufacturing a toner according to claim 26, wherein the toner is manufactured in a temperature range of from 20 to 60° C.

31. An image forming method comprising:

forming a latent electrostatic image on a latent electrostatic image bearing member;

developing the latent electrostatic image with the toner set forth in claim 1;

transferring the developed image to a recording medium; and fixing the transferred image to the recording medium.

32. An image forming method comprising:

supplying an image bearing member with the toner set forth in claim 1;

temporarily fixing a developed image on the image bearing member by forming the developed image with a portion of the toner contacting the image bearing member where heat is applied according to image signals;

transferring the temporarily fixed developed image to a recording medium; and thermally fusing and fixing the transferred image.

* * * * *